United States Patent [19]

Davis et al.

[11] 4,013,751

[45] Mar. 22, 1977

[54] FIBRILS AND PROCESSES FOR THE MANUFACTURE THEREOF

[75] Inventors: Joseph C. Davis, DeSoto, Kans.; Francis R. Galiano, Beaumont, Tex.; Robert W. Hill, Gibsonia, Pa.

[73] Assignee: Gulf Research & Development Company, Pittsburgh, Pa.

[22] Filed: June 14, 1974

[21] Appl. No.: 479,357

Related U.S. Application Data

[63] Continuation-in-part of Ser. No. 193,716, Oct. 29, 1971, abandoned, and Ser. No. 202,302, Nov. 26, 1971, abandoned, and Ser. No. 211,562, Dec. 23, 1971, abandoned, and Ser. No. 234,321, March 13, 1972, abandoned, and Ser. No. 236,189, March 20, 1972, abandoned, and Ser. No. 238,463, March 27, 1972, abandoned, and Ser. No. 254,456, May 18, 1972, abandoned, and Ser. No. 256,718, May 25, 1972, abandoned, and Ser. No. 287,494, Sept. 8, 1972, abandoned, and Ser. No. 322,317, Jan. 10, 1973, abandoned, and Ser. No. 322,327, Jan. 10, 1973, abandoned, and Ser. No. 322,592, Jan. 10, 1973, abandoned.

[52] U.S. Cl. ..... 264/140; 162/157 R

[51] Int. Cl.[2] ..... B01J 2/06

[58] Field of Search ..... 264/8, 140, 141; 162/157 R; 425/8, 10

[56] References Cited

UNITED STATES PATENTS

| | | | |
|---|---|---|---|
| 2,988,782 | 6/1961 | Parrish | 264/69 |
| 2,999,788 | 9/1961 | Morgan | 264/123 |
| 3,442,317 | 5/1969 | Wieland | 159/48 |
| 3,743,272 | 7/1973 | Nowotny et al. | 264/69 |

FOREIGN PATENTS OR APPLICATIONS

| | | | |
|---|---|---|---|
| 47-32131 | 8/1972 | Japan | 162/157 R |
| 1,142,253 | 5/1969 | United Kingdom | |

*Primary Examiner*—Robert F. White
*Assistant Examiner*—James R. Hall
*Attorney, Agent, or Firm*—Richard L. Kelly

[57] ABSTRACT

A process for producing a mass of entangled solvent swollen polymer filaments which can be converted into paper-making fibrils by subsequent refining. An olefin polymer such as polyethylene having an inherent viscosity of at least 3.5 is dissolved in a hot solvent. The hot polymer solution is subjected to timed sequential steps in which the polymer solution first is sheared and attenuated into fine polymer streams. The hot polymer streams then are cooled to precipitate the polymer which is recovered as a mass of entangled solvent swollen filaments. These filaments can be beaten in a non-solvent liquid such as isopropanol to prepare fibrils having diameters on the order of about 5 to 30 microns and lengths of about 1 to 15 millimeters.

17 Claims, 5 Drawing Figures

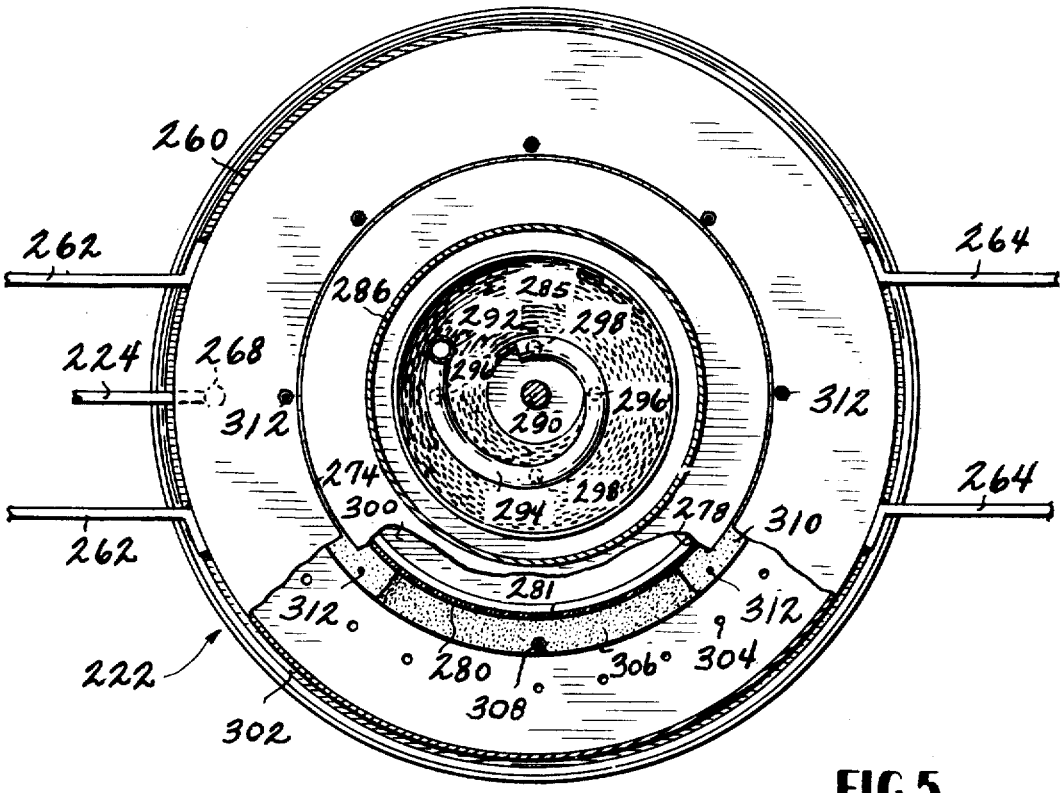
FIG 5
FIG 6
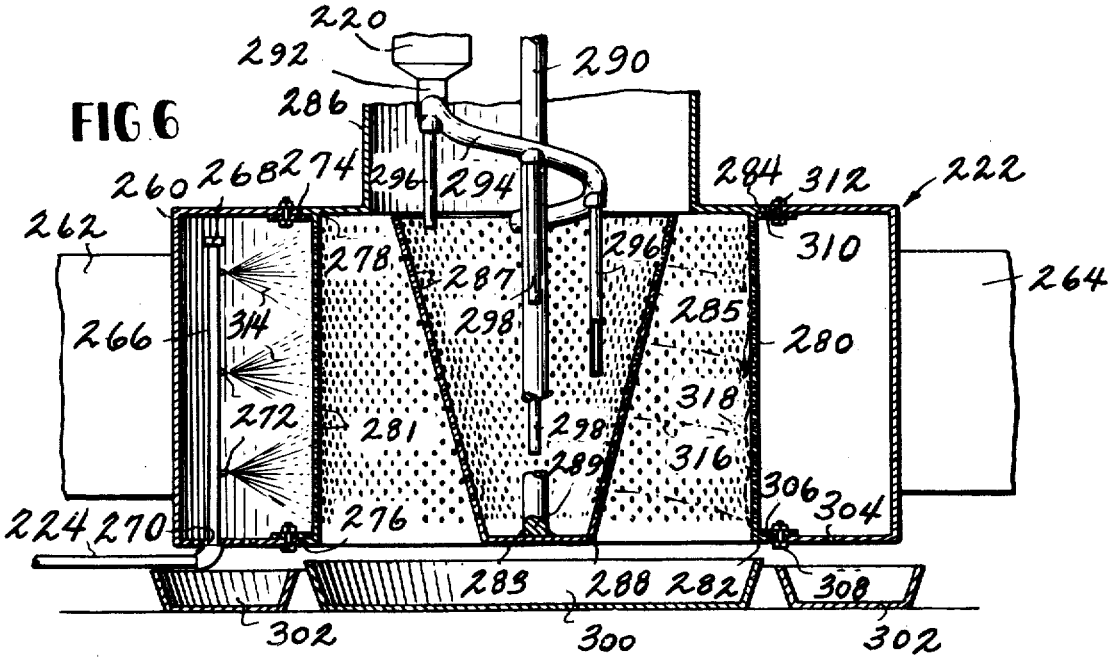

FIBRILS AND PROCESSES FOR THE MANUFACTURE THEREOF

CROSS-REFERENCE TO RELATED APPLICATIONS

This application is a continuation-in-part of several of our earlier filed copending applications:

| Serial Number | Filing Date |
|---|---|
| 193,716 | October 29, 1971 |
| 202,302 | November 26, 1971 |
| 211,562 | December 23, 1971 |
| 234,321 | March 13, 1972 |
| 236,189 | March 20, 1972 |
| 238,463 | March 27, 1972 |
| 254,456 | May 18, 1972 |
| 256,718 | May 25, 1972 |
| 287,494 | September 8, 1972 |
| 322,317 | January 10, 1973 |
| 322,327 | January 10, 1973 |
| 322,592 | January 10, 1973 |

Each of the above applications has been abandoned in favor of the present application.

BACKGROUND OF THE INVENTION

1. Field of the Invention

The subject invention relates to a new, useful and improved process for the formation of fibrils from very high molecular weight polymers. More particularly, the present invention pertains to an improved method for making fibrils from olefin polymers, polyethylene and polypropylene in particular, which are especially suitable for and adaptable to incorporation into paper or other sheet-like structures by the papermaking process. In this respect, the invention also pertains to the improved synthetic fibrils produced or made in accordance with the process of this invention.

One of the main applications of the fibrils produced in accordance with this invention and by the method of the invention is that application based on their ability to form coherent self-supporting water leaves which can be used for making sheet-like structures according to the methods and processes of paper manufacturing.

2. Descripiton of the Prior Art

Numerous efforts have been made to transform man-made polymers and fibers produced therefrom into structures which are similar to natural cellulosic paper, and which possess in the wet state sufficient coherence to enable them to be processed on conventional paper-making machines. However, most of these efforts have not been successful. This is particularly true with the olefin polymers such as polyethylene and polypropylene, due to the fact that fibers of both of these materials are hydrophobic, do not readily hydrate or fibrillate, and cannot be converted into self-bonding webs on paper-making machinery (see Page 51 of the paper entitled "Wet Formation with Synthetic Organic Polymers" by H. Mark presented at the sumposium on "Consolidation of the Paper Web", Cambridge, Sept. 1965). These failures may in part be due to the fact that, unlike natural cellulosic fibers, man-made fibers prepared according to ordinary production methods are usually not fibrillated when beaten in water, but only disintegrate into small chips.

Numerous special processes have been proposed for preparing polymer fibrils having characteristics rendering them suitable for use in paper-making processes.

Included among such processes are those described in U.S. Pat. Nos. 2,999,788 and U.S. 2,988,782. These patents describe a process in which a polymer is dissolved in a solvent and added to a liquid having essentially no solvent power for the polymer. A high level of agitation is provided as the polymer solution is added to the non-solvent liquid so that polymer solution is subjected to shearing forces to attenuate the droplets of polymer solution into fine streams to thereby orient the solute polymer molecules. The non-solvent liquid diffuses into the polymer solution and precipitates the polymer therefrom in the form of fine fibrils.

SUMMARY OF THE INVENTION

A novel process has been discovered which provides fibrils having physical characteristics well adapted for use in the manufacture of water-laid sheets such as paper. In the process, a very high molecular weight olefin polymer or polymer mixture containing at least 20 weight % of such high molecular weight olefin polymer is dissolved in an appropriate solvent at an elevated temperature above 100° C. and preferably in the range of 140°–160° C. to provide a solution having a viscosity of at least about 50 centipoises. The hot polymer solution, while being maintained at a temperature sufficiently high to keep the polymer in solution, is subjected to shearing forces so as to attenuate the hot polymer solution into fine liquid streams. Typically, this step is carried out by feeding the hot polymer solution into an apparatus having a rotating surface which imposes a large centrifugal force on the polymer solution and throws the polymer solution off the rotating surface of the apparatus in the form of fine streams. This action orients the solute polymer molecules in the fine streams. The fine polymer streams then are fed immediately into a cooling zone in which the fine polymer streams are rapidly cooled to a temperature sufficiently low so that substantially all of the solute polymer molecules are precipitated as solvent-swollen fine polymer filaments.

The solvent-swollen filaments can be separated and recovered as a mass of entangled filaments. They can be dried and stored for use. Alternatively, the solvent-swollen mass of entangled filaments can be suspended in a liquid having no solvent action on the filaments and beaten to suspend the individual filaments substantially uniformly throughout the suspending liquid. The filaments then can be recovered by filtration and dried. The product as thus recovered consists of readily separatable filaments having diameters of the order of 5 to 30 microns and lengths of about 1 to 15 millimeters.

BRIEF DESCRIPTION OF THE DRAWINGS

The novel features which are believed to be characteristic of this invention are set forth with particularity in the appended claims. Th invention itself, however, both as to its organization and method of operation together with further objects and advantages thereof may best be understood by reference to the following description taken in connection with the accompanying drawings in which:

FIG. 5 is a top plane view of a centrifuge spinning device which can be used in the embodiment of the invention illustrated in FIG. 4, with portions thereof being cut away;

FIG. 6 is a side elevation view of the centrifuge spinning device shown in FIG. 5, with portions thereof being cut away.

DETAILED DESCRIPTION OF THE INVENTION

Figure 1:
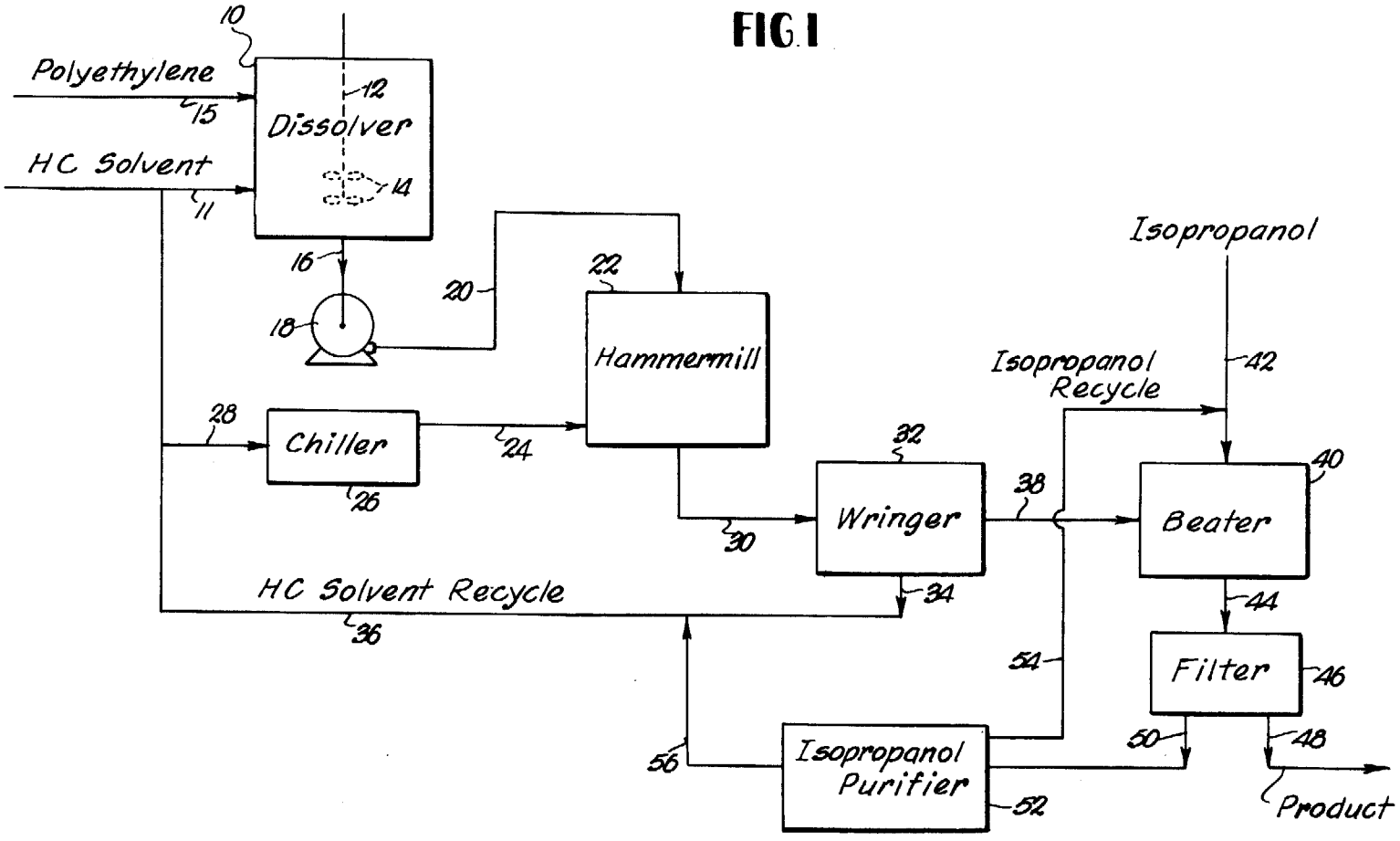
FIG. 1 is a block or flow diagram showing the various method or process steps of one embodiment of the invention in which a hammermill is employed to impose the shearing force on the hot polymer solution.

The process of this invention consists essentially of:

a. dissolving a polymer in a solvent at an elevated temperature above 100° C. to prepare a hot polymer solution having a viscosity of at least about 50 centipoises;

b. subjecting the hot polymer solution of (a) to shearing forces and attenuating the hot polymer solution into fine liquid streams to orient the solute polymer molecules in said fine liquid streams, c. throughout step (b) maintaining the polymer solution at a temperature sufficiently high to maintain substantially all of the solute polymer molecules in solution;

d. feeding the hot fine liquid streams or polymer solution from step (b) into a cooling zone in which the fine liquid streams or polymer solution are rapidly cooled to a temperature sufficiently low so that substantially all of the solute polymer molecules are precipitated as solvent-swollen fine polymer filaments; and e. recovering a mass of entangled solvent swollen fine polymer filaments from the solvent liquid formed in step (d).

The mass of entangled solvent-swollen filaments may be suspended in a liquid having no solvent action on the filaments and beaten to break down the mass of entangled filaments. The beating action causes the entangled mass of filaments to become disentangled and suspended in the liquid as essentially monofilaments. The freely suspended filaments then can be filtered and recovered. The filaments as thus recovered have diameters of the 5 to 30 microns and lengths of about 1 to 5 millimeters. Filaments of this size frequently are referred to in the art as fibrils.

The polymer employed in the process will consist of an olefin polymer having the inherent viscosity of at least 3.5, such olefin polymer being an ethylene homopolymer, an ethylene copolymer of a C-4 or higher olefin hydrocarbon with the polymerized ethylene constituting at least 90 weight % of the copolymer, a propylene homopolymer, or an ethylene-propylene copolymer containing at least 50 weight % of polymerized propylene. In lieu of the olefin polymer, it also is possible to use polymer mixtures containing at least 20 weight % of such an olefin polymer with any additional polymer included in the polymer mixture being soluble in the solvent employed in the process.

An essential feature of the invention is to carry out the process steps in sequence. The hot polymer solution, after being prepared, is subjected to the step in which the hot polymer solution is subjected to high shearing forces and attenuated into fine liquid streams. This process step orients the solute polymer molecules in the fine liquid streams. Throughout this step, the polymer solution is maintained at an elevated temperature sufficiently high so that essentially all of the solute polymer molecules are maintained in solution while they are being attenuated and orineted. Hammermills, centrifuges and extrusion dies having large ratios of length to cross-sectional area are well suited to carrying out this process step.

In the next step of the process, the fine polymer streams described above are fed into a cooling zone in which the fine liquid streams of polymer solution are rapidly cooled to a temperature sufficiently low that substantially all of the solute polymer molecules are precipitated as solvent-swollen fine polymer filaments. The polymer molecules are precipitated by reason of their differential solubility at the two temperatures prevailing in these two process steps.

The products obtained from the cooling step described above consist of a mass of entangled solvent-swollen fine polymer filaments in admixture with the polymer solvent and the coolant luquid which coolant liquid in certain embodiments of the invention may be chemically identical with the polymer solvent. The mass of entangled solvent-swollen fine polymer filaments are recovered from the excess liquid for subsequent treatment.

For reasons which are not understood, the filaments produced by the process of the invention are quite different in appearance and properties from filaments of similar cross-sectional area produced by alternate manufacturing processes.

As earlier noted, the filaments of the invention are produced by subjecting a hot polymer solution to shearing forces and attenuating the hot polymer solution into fine liquid streams to orient the solute polymer molecules. Thereafter, the oriented fine polymer streams are rapidly cooled to precipitate the solute polymer molecules from solution as oriented polymer filaments. By reason of the fact that multitudes of filaments are being formed simultaneously in close proximity to each other, the product recovered in this step of the process is a mass of entangled solvent swollen fine polymer filaments together with the solvent and any liquid coolant employed in the preceding step of the process. The mass of filaments can be separated from the solvent by filtering or centrifuging.

The mass of filaments as thus recovered somewhat resembles water-wetted cotton in appearance. Physical examination of the product suggests that it is made up of a mass of relatively long monofilaments having lengths well in excess of 25 mm and diameters widely ranging but often in excess of 100 microns. When attempts are made to pull the filaments apart, it is observed that they are so entangled that they often break when subjected to pulling forces. When so pulled, what originally appear to be monofilaments break in such a way as to indicate that they are made up of a plurality of extremely fine filaments, many of which have diameters so small as to be virtually unobservable to the naked eye. It is virtually impossible to separate the individual ultimate filaments for examination.

The mass of entangled solvent swollen filaments can be suspended in a liquid having no solvent action on the filaments and beaten in a manner similar to that employed in refining cellulose paper making fibers. On a laboratory scale, this can be done by beating 1–2% by weight of filaments in a suitable liquid such as isopropanol or water in a Waring blender. This action provides a smooth dispersion which appears to be homogeneous. Filtration and drying of the slurry provide a light fluffy product resembling in appearance the refined cellulosic paper making fibers of commerce.

For convenience of description, the filaments obtained immediately after cooling and precipitation will be referred to simply as filaments, whereas the fibers obtained after beating in a liquid suspension will be referred to as "fibrils".

Microscopic examination of the fibrils indicates that their cross-sectional area varies irregularly from fibril to fibril. Frequently, the cross-sectional area of a single fibril will vary over its length. It also is noted that many of the fibrils appear to consist of a principal strand with a number of side strands branching off of the principal strand. The physical nature of the fibrils suggests that possibly the final fibrils obtained are formed by a fusion of even finer filaments that were formed in intermediate stages of the process.

A majority of the fibrils will have cross-section diameters of the order of 5 to 30 microns. The length of the principal chains of the fibrils will range from about 1 to about 15 mm. Many of the fibrils appear to have voids or elongated cavities in their structure. The fibrils typically have a high surface to weight ratio of the order of about 50 $m^2$/gm.

Figure 3:
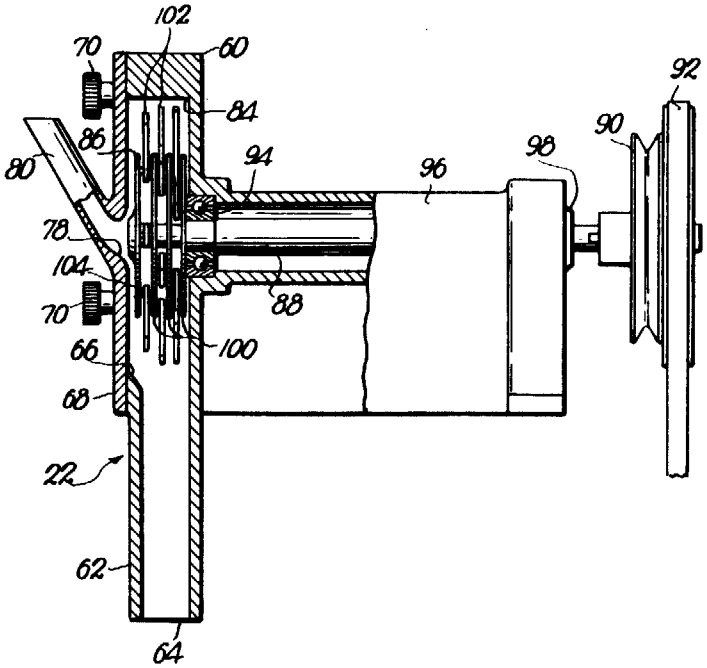
FIG. 3 is a side elevation view of the apparatus shown in FIG. 2, a portion thereof being cut away.
Figure 2:
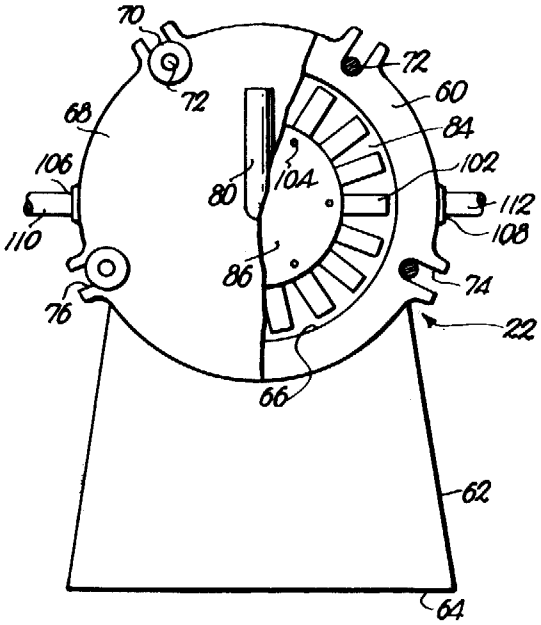
FIG. 2 is a front elevation view of the apparatus illustrated in FIG. 1, a portion thereof being cut away.

Referring to the drawings in detail, FIGS. 1–3 illustrate one embodiment of apparatus for carrying out the process of this invention. The process is initiated by first dissolving a suitable polymer such as linear polyethylene having an inherent viscosity of at least 3.5 in dissolver or vessel 10, the contents of which are stirred or agitated by stirrer 12 having attached paddles or blades 14 adjacent its lower end and rotated by a motor (not shown) external to dissolver 10. The polymer is fed to dissolver 10 by polymer fill line 15 from a suitable polymer source not shown.

A suitable solvent, such as kerosene, which is usually preheated, enters dissolver 10 through solvent supply line 11 from a suitable source of solvent supply. The hot polymer solution within dissolver 10 is normally maintained in a range of 140°–160° C. by suitable heating means not shown.

The polymer and the solvent are fed to dissolver 10 in a ratio such that the polymer solution being formed has a viscosity of about 50–30,000 centiposies when measured at 145° C.

The hot polymer solution prepared in dissolver 10 is fed through flow line 16, pump 18, and flow line 20 into centrifugal apparatus or hammermill 22. While within hammermill 22, by an action which will be subsequently described, the hot polymer solution is converted into a mass of solvent swollen polymer filaments. The fibrous mass of polymer filaments and associated liquids leave the hammermill by exit line 30.

The solvent swollen fibrous mass and associated solvent and coolant liquids are fed by outlet line 30 to a wringer 32. Within wringer 32 the swollen fibrous mass is separated from most of its associated liquids such as solvent and coolant, which may be the same. The separation is accomplished by a squeezing or pressing action of wringer 32 on the fibrous mass, and may be preceded either within or without wringer 32 by a filtration operation through a screen wherein a great majority of the liquids are separated from the fibrous mass. The separated liquids, both solvent and coolant when the same liquid is used for both, exit wringer 32 through line 34 and are recycled through flow line 36 to the hydrocarbon solvent supply for later reuse. The filaments in the form of a fibrous mass and in a slightly swollen state or condition are removed from wringer 32 and proceed through outlet duct 38 thereof.

The swollen fibrous mass proceeds through wringer outlet duct 38 into a beater 40 or other like refiner for further treatment. An alcohol, such as isopropanol when employing polyethylene as the polymer from which the fibrils are produced, is directed into beater 40 through isopropanol feed line 42 from a source of supply to aid in further treating, refining and removing excess or additional solvent from the fibrous mass. In addition to aiding in the removal of additional solvent from the fibrous mass, the alcohol acts as the suspending medium for the filaments within beater 40. The solvent swollen fibrous mass is cut or chopped into fibrils of desired length, such as from about 1 up to about 5 mm. for use in the production of paper or other sheet-like structures on papermaking machinery. Beater 40 may be a blender, disc refiner or other like beating and refining apparatus. The beating carried out within refiner 40 should be contined for a time sufficient to break down the solvent swollen fibrous mass into a plurality of individual fibrils.

For a final or concluding step of the process, the product of the beater consisting of fibrils, the alcohol or other suspending and refining medium, and to an extent the solvent used in dissolving the polymer is discharged from beater 40 through outlet line 44 and directed into a filter 46 for a final separation of filtration step. After the separation of filtration step, the product of the process exits filter 46 through solids outlet 48, this being the improved fibril or nonrigid particle of the invention. Also exiting filter 46 through a liquids outlet 50 is a combination of alcohol or other like suspending medium and a certain but smaller amount of the solvent used in the system. The liquid exiting filter 46 is directed through outlet line 50 into and through an alcohol purifier 52, this being labeled an isopropanol purifier in FIG. 1 as isopropanol is used in this embodiment as the suspending medium and refining aid. The purified isopropanol from purifier 52 is then fed through recycle line 54 back to the isopropanol supply for further use. The solvent medium which is separated from the isopropanol within purifier 52 is directed through flow line 56 from purifier 52 into solvent recycle line 36 and eventually back to the solvent supply. If desired, the product exiting filter 46 through discharge or outlet 48 may be steam stripped or water washed to remove any residual alcohol therefrom.

With particular reference to FIGS. 2 and 3, centrifugal spinning apparatus or hammermill 22 is seen to include a housing 60 having a downwardly and outwardly extending lower portion 62 which terminates at its lower most end in an opening or outlet 64. Housing 60 additionally includes an open front face behind which the moving or rotating parts of the hammermill are positioned. The open front 66 of hammermill 22 is normally covered or sealed by a removable front plate or cover 68 whereby the moving parts of hammermill 22 are completely enclosed when the same is in operation. Front plate or cover 68 is held in position on the front of housing 60 by means of a plurality of nuts 70 secured to the ends of bolts 72 which are pivotally mounted to housing 60 and extend through U-shaped slots 74 within housing 60 and similar U-shaped slots 76 in plate or cover 68. Removable front plate or cover 68 includes an opening or inlet 78 adjacent its center for communication with the interior of hammermill 22 and entry of materials into the moving portions of the hammermill. Inlet opening 78 is connected to and communicates with an inlet tube 80 for ready receipt of materials and entry thereof into hammermill 22 through its inlet opening 78.

Positioned within the cavity or open hollow internal chamber 84 of housing 60 are the movable parts of hammermill 22, which include a rotatable disc or plate 86 mounted on one end portion of a rotatable shaft 88. On the opposite end portion of shaft 88 is mounted a variable speed pulley 90 over which passes a belt 92 driven by a motor (not shown) for rotation of shaft 88. Shaft 88 is pivotally mounted through housing 60 by means of a ball bearing 94 and is covered and protected by a hood or housing 96 through which it is additionally pivotally mounted at 98. A plurality of discs or plates 100 are spacedly mounted on shaft 88 adjacent outer disc 86. A plurality of flails or hammers 102 are pivotally mounted about the circumference of plates or discs 86 and 100 by means of pins 104 extending between plates 86 and 100. Flails 102 pivot freely about pins 104 and upon rotation of shaft 88 they are thrown outward by centrifugal force to generally fill cavity 84 or the peripheral portion of housing 60 and take the position depicted in FIG. 2.

The apparatus 22 used in the process of this invention has been modified such that its housing 60 is provided with a pair of openings 106 and 108 respectively positioned opposite one another adjacent the sides of housing 60. Connected to opening 106 is a coolant feed line 110 and opening 108 communicates with and is connected to coolant feed line 112. Coolant feed lines 110 and 112 to housing 60 are connected to coolant supply line 24 whereby coolant supplied from chiller 26 is split and flows into cavity 84 adjacent hammers 104 within housing 60 via line 110 and opening 106 and line 112 and opening 108. While a pair of openings 106 and 108 have been shown in connection with the apparatus depicted in FIGS. 2 and 3, it will be readily understood that more openings may be provided if desired, and it is felt that a single opening through housing 60 would provide sufficient feeding means for supply coolant liquid to chamber 84 and the outer peripheral portion of housing 60 of the apparatus.

The coolant liquid supplied to centrifugal spinning apparatus or hammermill 22 is chilled to a temperature such that the temperature within chamber 84 or the peripheral portion of housing 60 and about flails or hammers 102 is maintained at a temperature well below the precipitation temperature of the polymer solution and preferably in the range of from about −10° C. up to about 40° C.

Of course, it will be appreciated, for larger scale operations, the apparatus depicted in FIGS. 2 and 3 and described hereinabove could include a number of rotating discs or plates (as at reference numeral 86) and preferably mounted on the same shaft. In such a case, stationary plates or discs (as at reference numeral 68) would be placed between the rotating discs thereby dividing the chamber of the centrifugal spinning apparatus into a number of cells. Polymer solution could then be fed to both sides of each rotating disc between the disc and its adjacent stationary plates or disc, while coolant liquid would be supplied to the peripheral portion of each cell as described hereinabove. The capacity of such a large scale unit would be limited only by the number of cells employed.

In operation, apparatus 22 is fed hot polymer solution through flow line 20 which connects with inlet tube 80 whereby the solution enters the apparatus through its inlet opening 78. Opening or inlet 78 is located at a point adjacent to the face of rotating plate or disc 86 where the tangential velocity of points on rotating disc 86 nearest inlet 78 is at least 100 cm./sec. This position may thus be varied for convenience depending on the diameter of disc 86 and the speed of rotation of this disc. Usually, the speed of rotation of disc 86 will vary from about 4,000 up to about 18,000 rpm. Upon contacting the face of plate 86, substantial energy is imparted into the hot polymer solution which is broken up into fine streams of polymer solution which are thrown into the cavity or chamber 84, which corresponds to the annulus of the apparatus defined by the flails 102. In passing through the narrow gap between face plate 68 and rotating disc 86, these fine streams of polymer solution are subjected to substantial shear force which act to orient the solute polymer molecules along the principal axis of the hot fine streams of polymer solution.

Coolant liquid is fed into the apparatus through lines 110 and 112, such coolant being fed to the apparatus at a rate higher than the weight of hot polymer solution being fed to the apparatus through inlet tube 80. Upon entering the apparatus, the coolant liquid is contacted by the rapidly rotating flails 102 attached to the rapidly rotating disc 86. The rotational action of the flails 102 together with the outbound flow of polymer solution prevent the coolant liquid from entering the center portion of the apparatus. The coolant is retained within chamber 84 and, of course, ultimately is discharged through exit 64.

The hot polymer streams being fed into chamber 84, i.e., the annulus defined by the flails 102, are contacted by the coolant that also is being fed into chamber 84. The coolant cools the hot fine polymer streams almost instantaneously to a temperature sufficiently low so that virtually all of the polymer solute molecules present in the fine polymer streams precipitate as solvent-swollen fine polymer filaments. Such polymer filaments have their polymer molecules highly oriented along the principal axis as a result of the shear forces which were imposed by the centrifugal action which originally formed fine streams of hot polymer solution.

At all times during the operation of the apparatus 22, the material present in the chamber 84 consists of a mass of precipitated solvent-swollen fine polymer filaments, coolant liquid, and newly formed fine streams of hot polymer solution entering the chamber. The rotary action of the flails 102 sweeps the materials into the discharge line 62 where the mass of solvent-swollen fine polymer filaments generally resembles a tow of fine polymer filaments which are fed to the downstream processing steps which have been previously described.

Figure 4:
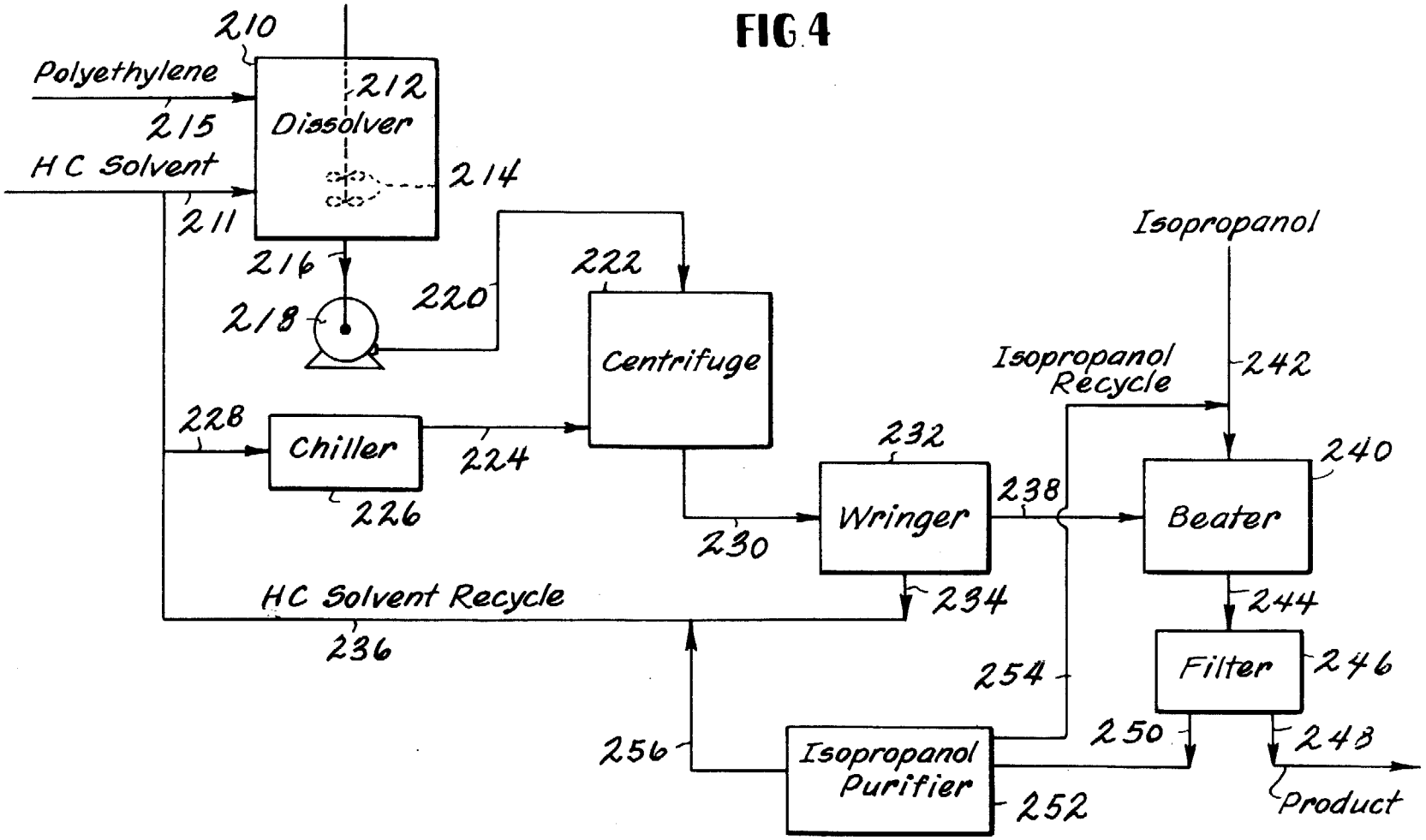
FIG. 4 is a block or flow diagram showing the various method or process steps of another embodiment of the invention in which a centrifuge is employed to impose the shearing force on the hot polymer solution.

FIGS. 4–6 illustrate another embodiment of apparatus for carrying out the process of the invention. The apparatus of FIGS. 4–6 differs from the apparatus of FIGS. 1–3 principally in that a centrifuge rather than a hammermill is employed to attenuate the hot polymer solution into fine liquid streams and thereby subjecting the solute polymer molecules to shearing forces.

The process is initiated by first dissolving a suitable polymer such as linear polyethylene having an inherent viscosity of at least 3.5 in dissolver or vessel 210, the contents of which are stirred or agitated by stirrer 212 having attached paddles or blades 214 adjacent its lower end and rotated by a motor (not shown) external to dissolver 210. The polymer is fed to dissolver 210 by polymer fill line 215 from a suitable polymer source not shown.

A suitable solvent, such as kerosene, enters dissolver 210 through solvent supply line 211. The hot polymer solution within dissolver 210 is normally maintained in a range of 140°–160° C. by suitable heating means not shown.

The polymer and the solvent are fed to dissolver 210 in a ratio such that the polymer solution being formed has a viscosity of about 50–30,000 centipoises when measured at 145° C.

The hot polymer solution prepared in dissolver 210 is fed through flow line 216, pump 218, and flow line 220 into centrifuge 222. While within centrifuge 222, the hot polymer solution is converted into a mass of solvent swollen polymer filaments. The fibrous mass of polymer filaments and associated liquids leave the centrifuge by exit line 230.

The solvent swollen fibrous mass and associated solvent and coolant liquids are fed by outlet line 230 to a wringer 232. The balance of the downstream processing illustrated in FIG. 4 directly corresponds to the downstream processing steps illustrated in FIG. 1 and previously described. Like parts in FIG. 4 bear numbers 200 units higher than the like parts shown in FIG. 1.

With particular reference to FIGS. 5 and 6, centrifugal spinning device or centrifuge 222 is seen to include a hollow cylindrical shaped housing 260 which is attached to and supported by a pair of brackets 262 and 264. Positioned within housing 260 is a generally upright standpipe 266, having its upper end sealed with a cap 268, which passes through an opening 270 within the bottom wall of housing 260. Standpipe 266 has its lower end portion connected to coolant supply line 224 and is provided with a plurality of nozzles, as at 272, which generally face toward the center of centrifugal spinning device 222. The purpose and function of standpipe 266 and contained spray nozzles or orifices 272 will be explained more fully hereinbelow.

Cylindrical housing 260 includes a central opening or passageway therethrough defined by the break at reference numeral 274 in its top or upper wall and the break at reference numeral 276 in its bottom or lower wall. Positioned within this central opening or passageway is a cylindrical shaped outer basket 278 which fits closely adjacent housing 260. Basket 278 includes a side wall 280, which is perforated or foraminous as at 281, a lower lip 282 and a upper lip 284. Attached to upper lip 284 of basket 278 is a cylindrical sleeve or tube 286 by which basket 278 is mounted for rotation within housing 260. Sleeve 286 and attached basket 278 are rotated within housing 260 by means of a motor and drive mechanism or other like rotating means (not shown).

Positioned within the center of device 222 is an inner spinning drum or cone 288, which is of an inverted conical shape. Cone 288 includes a lower or bottom wall 283 and a conical shaped sloping side wall or outer surface 285, which is perforated or foraminous as at 287, and is mounted for rotation within basket 278 by having its lower wall 283 attached to the lower end portion 289 of a rotatable shaft 290. Shaft 290 is rotated by a motor or other like means (not shown), which means may be the same means that rotate sleeve 286 and attached basket 278. The purpose and function of sloping outer surface 285 of cone 288 will be explained more fully hereinbelow.

Polymer solution flow line 220 enters device 222 through the hollow of sleeve 286 and has its lower end portion connected by a nipple 292 to solution fill line 294, which in turn feeds a plurality of polymer solution supply lines, as at 296. The lower end portions or exits 298 of polymer solution supply lines 296 are equally spaced circumferentially about the interior of cone 288 and equally spaced from top to bottom along the sloping side wall or surface 285 thereof.

Centrifugal spinning device 222 is completed by a stationary pan or trough 300 positioned beneath basket 278 to receive and collect the fibrous product forming on the foraminous side wall 280 of basket 278. An additional trough or pan 302 is provided to collect a substantial portion of the liquid discharge of device 222, this being the polymer solvent and the coolant liquid which exit housing 260 through a plurality of openings or passageways in its bottom wall, as at 304. Device 222 is additionally provided with a lower sealing ring or gasket 306 attached to the bottom wall of housing 260 by a plurality of nut and bolt combinations, as at 308, and an upper sealing ring or gasket 310 attached to the top wall of housing 260 by a plurality of nut and bolt combinations, as at 312, to generally seal the gap between housing 260 and rotatable basket 278 and prevent the inadvertent discharge of liquids from the device at these points.

The coolant liquid supplied to centrifugal spinning device 222 via coolant supply line 224 is chilled within chiller 226 to a temperature such that the spray, as at 314, exiting the plurality of nozzles 272 and impinging on the outer surface of foraminous side wall 280 of basket 278 maintains the temperature thereof well below the precipitation temperature of the polymer solution and preferably in the range of from about −10° C. up to about 40° C.

In operation centrifugal spinning device 222 is fed hot polymer solution through flow line 220, fill line 294 and the plurality of supply lines 296. The hot solution exits supply lines 296 through their lower end portions 298 and drops or impinges on the inside of foraminous sloping surface 285 of rapidly rotating cone or drum 288 at various points about the circumference thereof and at spaced intervals from top to bottom therealong. The solution after impinging upon cone 288 is flung outward therefrom by centrifugal force through perforations 287 in side wall 285 thereof and toward side wall 280 of basket 278. The speed of rotation of cone 288 should be such that the polymer solution is flung outward therefrom or given an acceleration thereby of at least 25 g's. or more. The solution, being acted upon by centrifugal force, generally follows the paths or tracings, as at 316, between side wall 285 and side wall 280, during which a shear is imparted to the viscous polymer solution. As the oriented streams of polymer solution hit the foraminous side wall 280 of basket 278, they cool into monofilaments which collect thereon as a ropy bundle of solvent swollen fibrils 318. In physical appearance, the collection of solvent swollen monofilament resembles a gelatinous fibrous mass similar in appearance to the produce obtained from the apparatus illustrated in FIGS. 1–3. The distance between the side wall 285 of cone 288 and the side wall 280 of basket 278 can be varied, but should be a minimum of at least 3½ or 4 inches to produce the fibrils by the improved process of this invention. While basket 278 is normally rotated (often at the same rate of rotation as cone 288), the same need not be rotated at all. However, when basket 278 is rotated, the rotation thereof aids in the removal of a portion of the polymer solvent from the ropy fibrous mass that collects on the inside of foraminous side wall 280. The thus separated polymer solvent passes through foraminous side wall 280 into housing 260 and exits the same through the plurality of openings 304 within the bottom wall thereof to collect within trough 302 from which the solvent can be recycled and used again. To aid in the cooling of the sheared and oriented polymer solution and the formation of fibrils therefrom, basket 278 is maintained in a chilled condition by a coolant liquid which is continuously sprayed on the outer surface of rotating basket 278. The coolant liquid is supplied through line 224, standpipe 266 and a plurality of nozzles 272 and exits therefrom in the form of a plurality of sprays 314 which impinge upon the outer surface of side wall 280 of basket 278. The spray of coolant liquid 314, after chilling basket 278, will be flung outward therefrom by centrifugal force, fall downward within housing 260 to exit the same through openings 304 and collect within trough 302 from which it may be recycled for further use. Due to the fact that the coolant liquid and the polymer solvent are commingled and mixed within trough 302 and housing 260, it is desirable and preferred to use a hydrocarbon liquid which acts as a solvent at an elevated temperature for the polymer and as a nonsolvent for the polymer at lower temperatures so that it may be used as the coolant liquid. The fibrous material which collects in the form of a solvent swollen mass on the inside of basket 278, as depicted at 318, will drop downward therefrom and collect in pan or trough 300 from which it is removed or transferred for further processing in accord with the invention. If desired, a finger-like member (not shown) may be provided to periodically scrape the inside of basket 278 to aid in the removal of the fibrous mass that builds up thereon.

While it has been described and illustrated that centrifugal spinning device 222, and particularly rotatable cylindrical shaped basket 278 thereof, is cooled or chilled by a coolant liquid flowing thereinto through supply line 224 and standpipe 266, this specific type of cooling or chilling is not required but is only illustrative of those types of cooling or chilling which are possible. To produce the improved fibrils by the process of this invention, it is preferred that the basket 278 be maintained in a chilled or cooled condition at the time the polymer solution is flung outward from rapidly rotating cone 288 toward basket 278. Means other than those depicted in the drawings and described hereinabove can be used in chilling or cooling the outer surface of foraminous side wall 280 of basket 278. As an example of these other means, dry ice should be placed within cylindrical housing 260 to maintain basket 278 in a chilled or cooled condition.

Figure 7:
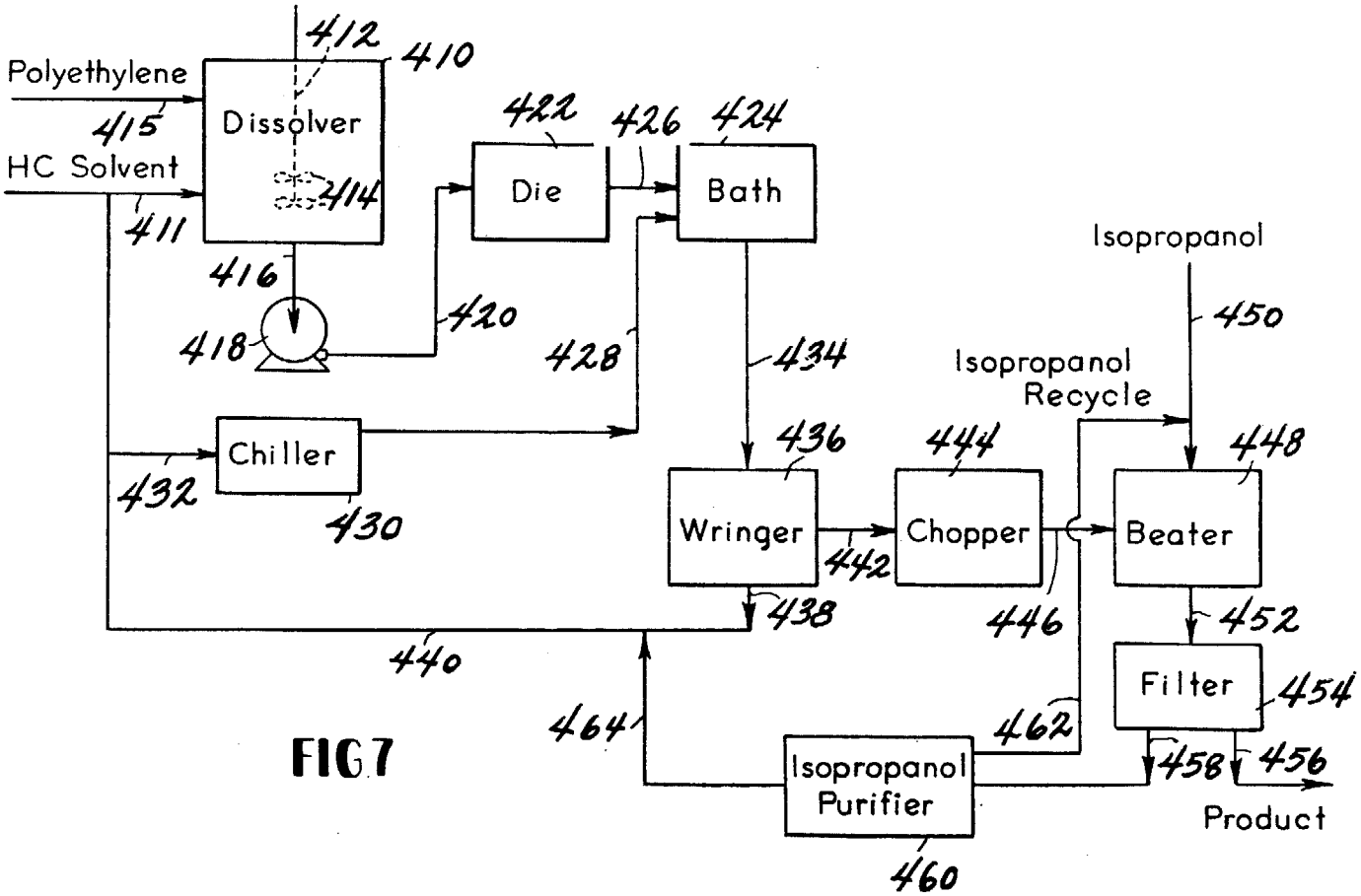
FIG. 7 is a block or flow diagram showing various method or process steps of another embodiment of the invention in which a die is employed to impose the shearing force on the hot polymer solution.

FIG. 7 illustrates another embodiment of apparatus for carrying out the process of this invention.

The process is initiated by first dissolving a suitable polymer such as linear polyethylene having an inherent viscosity of at least 3.5 in dissolver or vessel 410, the contents of which are stirred or agitated by stirrer 412 having attached paddles or blades 414 adjacent its lower end and rotated by a motor (not shown) external to dissolver 410. The polymer is fed to dissolver 410 by polymer fill line 415 from a suitable polymer source not shown.

A suitable solvent, such as kerosene, enters dissolver 410 through solvent supply line 411 from a suitable source of solvent supply. The hot polymer solution within dissolver 10 is normally maintained in a range of 140°–160° C. by suitable heating means not shown.

The polymer and the solvent are fed to dissolver 410 in a ratio such that the polymer solution being formed has a viscosity of about 50–30,000 centipoises when measured at 145° C.

After the polymer solution has been obtained in dissolver 410, the same is permitted to exit dissolver 410 through flow line 416 by means of pump 418 from which it is pumped through flow line 420 to the inlet of an elongated die or narrow tube 422. The hot viscous solution is then forced or pushed through die 422 by means of pump 418 wherein it is converted into a strand-like form. In passing through die 422, the hot polymer solution undergoes a shearing action during which the solute molecules become oriented, and thereafter the solution exits die 422 in the form of a strand having sufficient consistency to be handled, strung and further worked.

Die 422 need not be of one specific cross-sectional dimension and length, nor need the same have a certain specific cross-sectional configuration. However, we have found that the best fibrils result when die 422 has its smallest cross-sectional dimension (this being the diameter when the cross section of the die is of a circular shape) is in the range of from about 1 millimeter up to about 6 millimeters. Furthermore, we have found that for optimum fibril production the length of the die or narrow tube 422 should be about 100 times its smallest cross-sectional dimension. The hot viscous solution is forced through die 422 under conditions of laminar flow such that the solution undergoes shear resulting in an orienting of the solute molecules thereof. While it may be convenient to use a die, as at reference numeral 422, that has a circular cross section, other cross-sectional shapes may be employed, such as an elongated slit.

In leaving die 422, the polymer solution in the form of a molten strand is directed immediately to a cooling zone or quenching bath 424 along the path as indicated by reference numeral 426. The molten strand is passed through the cooling zone or bath 424 under tension to thereby maintain the strand in the sheared state with the solute molecules thereof in the oriented condition, as was imparted thereto during passage through die 422, throughout the cooling bath. Tension is maintained on the strand through bath 424 by means of a take-up or pair of take-up or nip rollers (not shown) at both the entrance to and exit from the bath 424. As the molten strand of the polymer solution is passed into and through cold quenching bath 424, which is maintained well below the precipitation temperature of the polymer solution, the polymer precipitates under conditions of zero shear and thereafter exits bath 424 as a solvent swollen fibrous strand. The rate of take-up of the strand from bath 424 by means of the heretofore mentioned take-up or nip rolls is geared to the rate of throughput of die 422. In one embodiment of this invention wherein a circular die, as at 422, having a 6 mm. diameter and a length of approximately 600 mm. was employed, take-up speeds of the strand exiting bath 424 varying from about 10 up to about 70 feet per minute were found to be possible and yield fine fibrils suitable for incorporation in the paper-making process.

While in operation and use, cooling zone or quenching bath 424 has flowing thereinto and through, via flow line 428, a cooled or chilled liquid to aid in the precipitation of the polymer and the formation of the solvent swollen fibrous strand produced therein from the polymer solution passing therethrough and having been acted by die 422. The cooled or chilled liquid entering device 422 may be a nonsolvent for the polymer dissolved in dissolver 410, such as isopropanol. However, preferably the same liquid, but at a substantially lower temperature, that is used to dissolve the polymer in dissolver 410 will be used and employed as the coolant which is pumped into cooling zone 424 through flow line 428. It is possible to employ the solvent used to dissolve the olefin polymer in dissolver 410 as the cooling or chilling liquid in bath 424, as many of the solvents used in dissolving these olefin polymers are nonsolvent for these polymers at chilled or other than elevated temperatures. In this manner, problems relating to solvent recovery are avoided. The chilled solvent or coolant liquid entering bath 424 may come from the same source of solvent supply as that pumped into dissolver 410, and when this is done it is first passed through a chiller 430 where it is cooled to a temperature of at least as low as 10° C. The coolant entering bath 424 passes from the source of solvent supply through flow line 432 into chiller 430 before entering bath 424 through flow line 428. The coolant liquid supplied to bath 424 via coolant supply line 428 is cooled within chiller 430 to a temperature such that the bath 424 is maintained at a temperature well below the precipitation temperature of the polymer solution and preferably in the range of from about −10° C. up to about 40° C. Due to the fact that the coolant liquid and the polymer solvent are commingled and mixed within bath 424, it is desirable and preferred to use a hydrocarbon liquid which acts as a solvent at an elevated temperature for the polymer and as a nonsolvent for the polymer at lower temperatures so that it may be used as the coolant liquid.

While it has been illustrated and mainly described as a bath, cooling zone or quenching bath 424 need not be a bath at all, but may be a zone wherein cooled air or another cooled gas is fed to the molten strand of polymer solution which is maintained under tension to thereby cause the polymer to precipitate under conditions of zero shear resulting in a solvent swollen fibrous strand. To produce this solvent swollen fibrous strand and the thereafter obtained fibrils by the process of this invention, it is only necessary and required that the molten strand, after having passed through die 422, be passed through a zone of quenching or cooling under tension to maintain the molecular orientation imparted thereto during the shearing in die 422, thereby causing precipitation of the polymer solute by purely thermal means (rapidly lowering the temperature) while the molecules thereof are oriented.

The discharge exiting cooling zone or quenching bath 424 consists of a solvent swollen fibrous strand and associated solvent and coolant liquids which are led outward therefrom along path 434 to a wringer 436. Within wringer 436 the solvent swollen fibrous strand is separated from most of its associated liquids such as solvent and coolant, which as has been stated hereinabove may be the same. The separation is accomplished by a squeezing or pressing action of the wringer 436 on the fibrous strand. The separated liquids, both solvent and coolant when the same liquid is used for both, exit wringer 436 through line 438 and are recycled through flow line 440 to the hydrocarbon solvent supply for later reuse. The recycled liquids to the hydrocarbon supply can then be reheated and used to dissolve more olefin polymer in dissolver 410 and/or cooled in chiller 430 and recirculated to cooling bath 424. The fibrils in the form of a fibrous strand and in a swollen state or condition are removed from wringer 436 and proceed therefrom along path or flow line 422 to the next processing step or operation in this process. The cooling liquid contained within quenching bath 424 may be directly recycled through chiller 430 without passing through wringer 436 to be continuously and constantly cooled and circulated through bath 424 to maintain the temperature thereof well below the precipitation temperature of the polymer solution as has been explained hereinabove.

The swollen fibrous strand proceeds from the outlet of wringer 436 along path 422 into a chopper 444 for further treatment thereof. In chopper 444, the solvent swollen fibrous strand is cut or chopped into segments of desired length such that the fibrils which will later result therefrom are of a suitable length for use in the fabrication of paper or other like sheet structures in the paper-making process. Preferably, the fibrous strand is cut or chopped within chopper 444 into lengths of up to about 3 inches for further use and employment in the fibril process and in the fabrication of paper or other sheet-like structures on paper-making machinery.

After being cut or chopped into desired lengths within chopper 444, the solvent swollen fibrous strand, now in discrete lengths, is fed through outlet duct 446 of chopper 444 into a beater 448 or other like refiner for further treatment and processing in accordance with the fibril process of the invention. An alcohol, such as isopropanol which is preferred when employing polyethylene as the polymer from which the fibrils are produced, is directed into beater 448 through isopropanol feed line 450 from a source of supply to aid in the further treating, refining and removing of a portion of the solvent from the fibrous strand now cut or chopped into discrete lengths. In addition to aiding in the removal of excess or additional solvent from the cut or chopped fibrous bundles, the alcohol acts as the suspending medium for the fibrils within beater 448. The beater 448 in which the solvent swollen fibrous strand, now in the form of cut or chopped discrete length fibril bundles, is refined may be a blender, disc refiner or other like beating and refining apparatus. The beating carried out within beater or refiner 448 should be continued for a time sufficient to break down the solvent swollen fibrous bundles into a plurality of individual fibrils.

For a final or concluding step of the process, the product of the beater consisting of fibrils, the alcohol or other suspending and refining medium, and to an extent the solvent used in dissolving the polymer is discharged from beater 448 through outlet line 452 and directed into a filter 454 for a final separation or filtration step. After the separation or filtration step, the product of this improved process exits filter 454 through solids outlet 456, this being the fibril or nonrigid particle produced by the invention. Also exiting filter 454 through a liquids outlet 458 is a combination of alcohol or other like suspending medium and a certain but smaller amount of the solvent used in the system. The liquid exiting filter 454 is directed through outlet line 458 into and through an alcohol purifier 460, this being labeled an isopropanol purifier in FIG. 7 as isopropanol is used in the preferred embodiment as the suspending medium and refining aid wherein linear polyethylene is used as the polymer from which the fibrils are formed. The purified isopropanol from purifier 460 is then fed through recycle line 462 back to the isopropanol supply for further use. The solvent medium which is separated from the isopropanol within purifier 460 is directed through flow line 464 from purifier 460 into solvent recycle line 440 and eventually back to the hydrocarbon supply. If desired, the product exiting filter 454 through discharge or outlet 456 may be steam stripped or water washed to remove any residual alcohol therefrom. This additional step is not necessarily required, but will be necessary if the fibrils are to be used in a paper-making process employing a purely aqueous medium. If the refining and beating was carried out in a hydrocarbon medium, it may at this point be desirable or necessary to steam strip the fibrils to remove a major or substantial portion of the residual hydrocarbon.

The olefin polymer employed in the process of the invention will be a high molecular weight polymer having polymerized therein principally ethylene and/or propylene.

One species of such polymers consists of ethylene polymers containing, on a weight basis, at least 90% of polymerized ethylene. Such ethylene polymers will be ethylene homopolymers or ethylene copolymers containing small quantities of $C_4$ or higher olefin comonomer such as butene, hexene, styrene, a conjugated diene such as butadiene, or the like. For convenience of expression, the term polyethylene will be used herein to designate both true ethylene homopolymers and ethylene copolymers which contain only another olefin as the comonomer. Such ethylene polymers can be prepared by well-known methods such as the so-called Phillips process and the Ziegler process. Such processes are described in numerous issued U.S. patents and technical publications well known to the art.

A second species of such olefin polymers consists of propylene polymers containing, on a weight basis, at least 50% of polymerized propylene. Such propylene polymers will be propylene homopolymers, or propylene copolymers containing up to 50% of copolymerized ethylene. For convenience of expression, the term polypropylene will be used to designate both true propylene homopolymers and propylene copolymers which contain only ethylene as the comonomer. Such propylene polymers can be prepared by well-known methods as by polymerization in a hydrocarbon medium in the presence of a catalyst formed by the reaction between titanium trichloride and an aluminum alkyl. Such processes are described in numerous issued U.S. patents and technical publications well known to the art.

The olefin polymers to be employed in the process of this invention to obtain the improved fibrils of this invention will be a very high molecular weight olefin polymer which has an inherent viscosity of at least 3.5 and one whose inherent viscosity can range substantially upward from 3.5 and preferably above 10.0, as illustrated in the following examples. The inherent viscosity of the polymer is defined by the following formula:

$$\text{Inherent Viscosity} = \frac{\ln t/t_o}{c}$$

wherein $t$ = fall time or time for passage through the viscosimeter of the polymer solution, $t_o$ = fall time of the solvent and $c$ = the concentration of the polymer in the solvent. In all inherent viscosity measurements, as set forth herein, the determination was made at a concentration of 0.05 g. of polymer per 100 ml. of decalin at 135° C.

In the preparation of the fibrils of this invention, fibrils having a highly satisfactory combination of overall properties are obtained when the polymer employed in the process consists entirely of an olefin polymer as described above. It has been observed, however, that fibrils of generally satisfactory properties can be obtained when a mixture of polymers is employed in the process, provided that the olefin polymer as described above, constitutes at least about 20 weight % and preferably, at least 35 weight % of the total polymer employed in the fibril-manufacturing process.

Where polymers other than an olefin polymer, as described above, are employed as a part of the polymer used in the fibril-manufacturing process, the other polymers employed may be employed for either of two principal purposes. For one, such other polymers can be employed principally to lower the raw material cost of the fibrils to be prepared. In some cases, such other polymers can be employed to modify specific properties of the fibrils themselves, or the water-laid, paper-like sheets prepared therefrom. Regardless of the purpose for which such other polymers are employed, for convenience of description, the polymers employed in the fibril-manufacturing process, in addition to the olefin polymers described above, will be referred to as "diluent polymers".

The diluent polymers employed in the invention must be completely soluble in the solvents employed in the fibril-manufacturing process at the temperatures employed to dissolve the polymers. The diluent polymers having the requisite solubility in the solvents employed in this process (as described supra) will be apparent to those skilled in the art.

The diluent polymers normally will be polymers of non-polar hydrocarbon monomers such as ethylene, propylene, isobutylene, styrene, and conjugated dienes such as butadiene and isoprene. The diluent polymers may be homopolymers of such nonpolar hydrocarbon monomers or copolymers prepared solely from mixtures of two or more of such nonpolar hydrocarbon monomers such as ethylene-propylene copolymers, styrene-butadiene copolymers and the like. Copolymers of such nonpolar hydrocarbon monomers with polar monomers such as acrylic and methacrylic acid, maleic anhydride, acrylic and methacrylic acid esters such as ethyl acrylate, methyl methacrylate, vinyl acetate, and vinyl pyrrolidone also may be employed so long as the content of the polar monomer is kept at a sufficiently low level so that the diluent polymer will be soluble in the solvent at the concentration of the diluent polymer employed.

One class of diluent polymers that can be employed in the fibril-manufacturing process are olefin polymers essentially similar to the olefin polymers described above, but which have inherent viscosities lower than 3.5. Such polymers include both the so-called linear polyethylenes manufactured by the Phillips and Ziegler processes, and the so-called low density ethylene polymers prepared by high pressure, mass polymerization processes in stirred autoclaves or tubular reactors.

Our copending application Ser. No. 236,189, filed Mar. 20, 1972, now abandoned, discloses a process in which a low density ethylene homopolymer having a density below 0.94 and a melt index above 1.0 (as determined by ASTM Test No. D1238-65T, Condition E) is used in conjunction with an olefin polymer having an inherent viscosity of at least 3.5 in the fibril-manufacturing process described in this application. The low density ethylene homopolymer is employed in the amount of, on a weight basis, from about 10% to about 25% of the olefin polymer having an inherent viscosity of at least 3.5. It has been observed that paper sheets prepared from such fibrils, as compared with paper sheets prepared from fibrils manufactured solely from an olefin polymer having an inherent viscosity of at least 3.5, possess certain improved physical properties, particularly increased tensile strength.

Our copending application Ser. No. 234,321, filed Mar. 13, 1972, now abandoned, discloses a process in which a styrene homopolymer is admixed with an olefin polymer having an inherent viscosity of at least 3.5 in the fibril-manufacturing process described in this application. The styrene homopolymer is employed in the amount of, on a weight basis, from about 5% to about 35% of the olefin polymer having an inherent viscosity of at least 3.5. It has been observed that paper sheets prepared from such fibrils, as compared with paper sheets prepared from fibrils manufactured solely from an olefin polymer having an inherent viscosity of at least 3.5, possess certain improved physical properties, particularly increased tensile strength.

Our copending application Ser. No. 238,463, filed Mar. 27, 1972, now abandoned, discloses a process in which certain propylene polymers are admixed with an olefin polymer having an inherent viscosity of at least 3.5 in the fibril manufacturing process described in this application. The propylene polymers are employed in the amount of, on a weight basis, from about 5 to about 35% of the olefin polymer having an inherent viscosity of at least 3.5. It has been observed that paper sheets prepared from such fibrils, as compared with paper sheets prepared from fibrils manufactured solely from an olefin polymer having an inherent viscosity of at least 3.5, possess certain improved physical properties, particularly increased tensile strength.

Our copending application Ser. No. 254,456, filed May 18, 1972, now abandoned, discloses a process in which a copolymer of maleic anhydride and either styrene or a mono-1-olefin containing at least 6 carbon atoms, and preferably between 6 and 18 carbon atoms, is used in conjunction with an olefin polymer having an inherent viscosity of at least 3.5 in the fibril manufacturing process described in this application. The maleic anhydride copolymer is employed in the amount of, ona weight basis, from about 10% to about 25% of the olefin polymer having an inherent viscosity of at least 3.5. It has been observed that the fibrils prepared by this process, as compared with fibrils manufactured solely from an olefin polymer having an inherent viscosity of at least 3.5, are more hydrophilic. It also has been observed that paper sheets prepared from such fibrils, as compared with paper sheets prepared from fibrils manufactured solely from an olefin polymer having an inherent viscosity of at least 3.5, possess certain improved physical properties, particularly increased tensile strength.

Our copending application Ser. No. 256,718, filed May 25, 1972, now abandoned, discloses a process in which certain olefin copolymers are used in conjunction with an olefin polymer having an inherent viscosity of at least 3.5 in the fibril manufacturing process described in this application. The diluent olefin copolymer is employed in the amount of, on a weight basis, from about 5 to about 95% of the olefin polymer having an inherent viscosity of at least 3.5. It has been observed that the fibrils prepared by this process, as compared with fibrils manufactured solely from an olefin polymer having an inherent viscosity of at least 3.5, are more hydrophilic. It also has been observed that paper sheets prepared from such fibrils, as compared with paper sheets prepared from fibrils manufactured solely from an olefin polymer having an inherent viscosity of at least 3.5 possess certain improved physical properties, particularly increased tensile strength.

Our copending application Ser. No. 287,494, filed Sept. 8, 1972, now abandoned, discloses a process in which certain vinyl pyrrolidone polymers are used in conjunction with an olefin polymer having an inherent viscosity of at least 3.5 in the fibril manufacturing process described in this application. The vinyl pyrrolidone polymers contain (a) polymerized monomer units conforming to the formula:

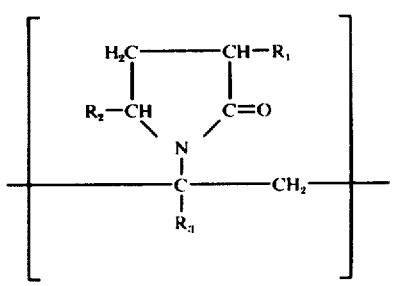

(A)

wherein $R_1$, $R_2$ and $R_3$ are independently hydrogen or an alkyl group containing 2 to about 180 carbon atoms, and (b) polymerized monomer units of the formula:

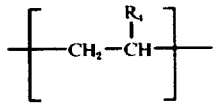

(B)

wherein $R_4$ is hydrogen or an alkyl group containing 1 to about 180 carbon atoms. The unit (A) will constitute from about 90 to about 99 mol percent of the total of units (A) plus (B). The vinyl pyrrolidone polymer is employed in the amount of, on a weight basis, from about 5 to about 25% of the olefin polymer having an inherent viscosity of at least 3.5. It has been observed that the fibrils prepared by this process, as compared with fibrils manufactured solely from an olefin polymer having an inherent viscosity of at least 3.5, are more hydrophilic. It also has been observed that paper sheets prepared from such fibrils, as compared with paper sheets prepared from fibrils manufactured solely from an olefin polymer having an inherent viscosity of at least 3.5, possess certain improved physical properties, particularly increased tensile strength.

The disclosure of the six copending applications described in the six paragraphs above were incorporated by reference into the disclosures of our copending applications Ser. Nos. 322,317; 322,327; and 322,592; each of which was filed on Jan. 10, 1973. Each of these applications has been abandoned in favor of the present application. The disclosures of each of these applications are incorporated into this application by reference.

The solvent to be employed in the invention may be any liquid which will completely dissolve the olefin polymer employed in the process at an elevated temperature. It is highly desirable that the solvent employed have a significantly different capacity to dissolve the olefin polymer at different temperatures. The ideal solvents are those having a very low solubility for the olefin polymer at ambient temperature, but having a high degree of solvent power for the olefin polymer at temperatures above 140° C. Hydrocarbon solvents such as kerosene, mineral spirits, tetraline and aromatic hydrocarbons such as the xylenes, have excellent characteristics for use in the invention and are the preferred solvents to be employed in the invention. Other solvents, however, such as certain of the chlorinated hydrocarbons, also can be employed if desired. The solvents employed should be liquids at ambient temperature and preferably should have atmospheric boiling points above 150° C. and preferably above 180° C.

The mechanical apparatus employed to attenuate the hot polymer solution into fine liquid streams and to subject the hot polymer solution to shear forces may be any of diverse types which will perform these functions. Any apparatus which contains a rotating surface which will break the hot polymer solution down into thin liquid streams and impose shearing forces on such streams are well suited for the purposes of the invention.

The particular cooling means employed in the process may be of many diverse types but should have the capability of rapidly withdrawing heat from the fine liquid streams of hot polymer solution so as to rapidly precipitate the solute polymer molecules in the hot fine liquid polymer solution streams. One of the best means presently visualized is the means illustrated in the embodiment shown in FIGS. 1–3 in which a coolant liquid is employed to physically contact the fine liquid polymer solution streams. In this mode of operation, the coolant liquid should be employed in an amount, on a weight basis, that at least equals the weight of the polymer solution. The coolant liquid employed may be of essentially any chemical type, but desirably should have a relatively high specific heat and should have an atmospheric boiling point above about 80° C. The solvent employed in the process also may be employed as the coolant. The use of the solvent as the coolant simplifies the recovery and recycling of the solvent. If a different coolant liquid is employed, the liquid recovered from the monofilaments produced will have to be recovered and separated before being recycled to the process. Water is an excellent coolant to be used for this purpose since, on standing, the solvent and water will separate for easy recovery and recycling.

Where the fine streams of liquid polymer solution are cooled by impinging upon a cooled surface as illustrated in the embodiments of FIGS. 4–7, the heat transfer surface should be fabricated from a material having good thermal conductivity, metals being preferred for this purpose. Indirect heat transfer means should be provided to rapidly remove the heat from such surface.

In the final step of the process, the mass of entangled solvent swollen filaments should be suspended in a liquid having little or no solvent power for the olefin polymer. The apparatus employed for this purpoe may be a blender, disc refiner, or any like beating and refining apparatus employed in the paper-making arts. The beating is carried out for a period of time sufficient to disentangle the filaments so that they become suspended in the suspending liquid as essentially individual filaments or fibrils of the dimensions previously discussed. The resulting slurry can be filtered or centrifuged to recover the fibrils.

In some cases, it is desirable to chop the monofilaments into discrete lengths before feeding them to the beating and refining step described above.

In the beating or refining step as set forth above, the final traces of the solvent employed in the process are removed from the fibrils. Where it is desired to reduce the residual solvent content of the fibrils to the lowest possible level, it normally is desirable to employ in the beating step an alcohol, such as isopropanol, which readily dissolves the hydrocarbon solvent employed in the process. Other solvent media which can be employed for this purpose include acetone, methyl ethyl ketone, and the like.

It also is possible, if desired, to employ chilled solvent as the suspending medium in the refining step. In this embodiment, the amount of residual solvent retained in the fibrils will be somewhat higher than is the case where an alcohol or a ketone is employed. The solvent level, however, can be reduced by heating the recovered fibrils, preferably in the presence of steam, after they are recovered from the beating step.

In still another alternative embodiment of the invention, the refining of the solvent swollen monofilaments within the beater can be carried out employing water as the suspending medium. The inclusion of surfactants in the aqueous medium assits in reducing the solvent content of the beaten fibrils.

Regardless of the precise mode in which the refining is carried out within the beater, the solvent content of the fibrils should be reduced to a point such that the solvent constitutes less than 5% of the finished fibrils on a dry basis.

For reasons not thoroughly understood, the fibrils produced by the process of the invention have physical characteristics distinctly different from chopped monofilaments produced by conventional textile manufacturing methods. The fibrils obtained by the process of the invention have irregular surfaces which enable the fibrils to interlock with each other when deposited as water-laid sheets from aqueous suspensions. Water-laid sheets can be prepared from a papermaking slurry in which the fibrils themselves are the sole fibers employed in the slurry. In addition, water-laid sheets of superior properties are obtained when the fibrils are employed in admixture with conventional cellulosic fibers. Water-laid sheets of excellent properties can be prepared from paper-making slurries in which the fibrils of the invention constitute, on a weight basis, from about 5 to about 50% of the fibers with cellulosic fibers constituting the balance of the fibers.

By reason of the process by which the fibrils of the invention are prepared, it is possible to make many modifications of the fibrils which improve their utility in the manufacture of water-laid sheets. By way of example, certain inorganic pigments, fillers, and the like can be incorporated into the polymer solution and remain physically encapsulated within the polymer filaments when they are precipitated from the fine polymer streams in the cooling step. Typical of the pigments that can be employed for this purpose include titanium dioxide, silcia, calcium carbonate, calcium sulfate, and the like. In another variation of the invention, cellulosic paper-making fibers can be incorporated into the polymer solution and are encapsulated within the monofilaments in the cooling step. Water-laid sheets prepared from such modified fibrils have enhanced opacity, improved printing characteristics, high water resistance, and the like.

The following examples are set forth to illustrate the principle and practice of the invention to those skilled in the art.

EXAMPLE 1

In this example, the improved fibrils of this invention are produced using a modified laboratory hammermill as the centrifuge spinning apparatus. The fibers obtained are used to fabricate a paper sheet, some of the physical properties of which were measured and are set forth hereinbelow.

The dissolver 10 used in this example was a 50 gal. stainless steel vessel equipped with a stirrer, as at reference numeral 12 in FIG. 1. The vessel had its bottom or exit port 16 connected to and communicating with a pump, such as shown at reference numeral 18. The exit side of the pump is attached to flow line 20 which leads to and communicates with the hammermill inlet tube 80 and inlet opening 78. The hammermill employed has been modified by the addition of coolant flow lines, such as lines 110 and 112 shown in FIG. 2, so that coolant liquid can be pumped into cavity or chamber 84 wherein mixing with polymer solution takes place.

The dissolver vessel was charged with 150 lbs. of the substantially aliphatic hydrocarbon solvent Speedsol (boiling range 155°–180° C.), 681 g. (1.5 lbs.) of a linear high molecular weight polyethylene and 3.4 g. of a mixture of equal parts by weight of Ionol, Santonox R (trademarks) and dilauryl thiodipropionate. The ethylene polymer used had an inherent viscosity of 13.33 measured at a concentration of 0.05 g./100 ml. of decalin at 135° C. The mixture was heated to 150° C. and held at that temperature with stirring for a period of 4 hours to dissolve the polyethylene, resulting in a solution having a viscosity of 690 centipoises (at 145° C.) and containing about 1.0 weight percent polyethylene. The solution then was pumped into the hammermill whose rotor was rotating at 11,100 rpm, while the coolant, also Speedsol, was simultaneously being pumped into cavity or chamber 84 via lies 110 and 112. By controlling the temperature of the coolant entering chamber or cavity 84 within housing 60 of hammermill 22, it was possible to control and maintain the temperature within the mixing zone of cavity or chamber 84 at any desired level. In this particular example, the temperature within the mixing zone in cavity 84 was maintained at 0° C. Operating at these conditions the beginning polyethylene solution exited hammermill 22 through its outlet 64 in the form of a solvent-swollen fibrous mass, which was collected on a screen to partially separate the fibrous mass from the associated liquids and for further processing thereof. This fibrous mass then was put through a wringer, as at 32, wherein it was pressed free of excess Speedsol and then directed to a refiner or beater, as at 40, for further treatment and refining. The beater or refiner used in this example was a Waring blender. The fibrous mass was beaten in this blender to which isopropanol was supplied until a uniform suspension of fibrils was obtained. The suspension was filtered, reslurried and resuspended in fresh alcohol and further beaten in the blender. This operation then was again repeated. The filtrate containing residual Speedsol solvent could be reclaimed from the ground and refined fibrils. the resultant fibril product was used to make paper hand sheets on a Noble and Wood sheet-forming machine. To obtain the paper hand sheets, the fibril product of the process of the invention was slurried to the head box of the Noble and Wood machine and a sheet was formed thereon by the usual and normal methods employed in the use of this sheet-forming machine. Some of the physical properties of the sheets formed from the fibrils of this example are set forth hereinbelow in Table I.

EXAMPLE 2

In this example, fibrils were prepared and refined as in Example 1, and paper sheets were formed from these fibrils in a manner identical to that followed in Example 1 with one exception. In this example, the coolant flowing to hammermill 22 and into cavity or chamber 84 thereof from chiller 26 through flow line 24 and feed lines 110 and 112 was maintained at such a temperature that the temperature within chamber or cavity 84 of the hammermill wherein the mixing of the polymer solution and the coolant occurs was maintained at a temperature of 5° C. The measured and recorded properties of the sheets prepared from the fibrils obtained in this example are given in Table I below.

EXAMPLE 3

In this example, fibrils were prepared and refined by the methods and procedures carried out in Example 1, and paper sheets were prepared therefrom in the manner identical to that employed in Example 1 with a single exception. The exception is that the coolant entering the mixing zone of hammermill 22 from chiller 26, flow line 24 and feed lines 110 and 112 was maintained at such a temperature that the temperature within this zone of mixing between polymer solution and coolant within chamber or cavity 84 was maintained at −10° C. The physical properties of the sheets prepared on the Noble and Wood sheet-forming machine from the fibrils produced in this example were determined and are recorded in Table I as follows:

Table I

| Property* | Example 1 | Example 2 | Example 3 |
|---|---|---|---|
| Hammermill Chamber Temp. | 0° C. | 5° C. | −10° C. |
| Basis Weight, lbs./3 M ft.² | 50.31 | 54.87 | 50.24 |
| Tensile, pli | 5.41 | 6.18 | 5.40 |
| Tensile Factor | 0.11 | 0.11 | 0.10 |
| Stretch, % | 5.32 | 5.11 | 3.97 |
| Elmendorf Tear, g./sheet | 158.00 | 178.00 | 170.00 |
| Elmendorf Tear Factor | 3.21 | 3.29 | 3.50 |

*Tappi Procedure No. T220 M-60

EXAMPLE 4

In this example, fibrils were prepared and refined as in Example 1, and paper sheets were formed from these fibrils in a manner identical to that followed in Example 1 but with a high molecular weight polypropylene. The polypropylene resin employed in this example to make fibrils had an inherent viscosity of approximately 5.0 and contained 23% heptane extractables. 30 g. of this high molecular weight polypropylene was dissolved in 3 liters of the hydrocarbon solvent Speedsol at a temperature of 150° C., resulting in a solution containing about 1.3 weight % polypropylene. This solution was fed to the hammermill which was revolving at 11,136 rpm while the coolant, also Speedsol, at a temperature −35° C. was simultaneously being pumped into the outer or peripheral portions of the hammermill. The resulting solvent-swollen fibrous mass exited the hammermill through its outlet and was collected. The collected fibrous mass was beaten and refined in isopropyl alcohol as in Example 1. The resultant refined fibril product was used to make paper hand sheets on a Noble and Wood sheet-forming machine as was done in Example 1. The resulting hand sheets were strong, tough and possessed good paper qualities.

EXAMPLES 5–14

In these examples, fibrils were prepared and refined and paper sheets were formed from these fibrils as was done in Example 4. Some of the properties of the olefin polymer employed and the polymer solution used in preparing the fibrils of these examples is set forth hereinbelow in Table II.

Table II

| Example | Resin | Inherent Viscosity of Resin[1] | % Solids of Solution[2] | Viscosity of Solution[3] |
|---|---|---|---|---|
| 5 | Polyethylene | 13.33 | 0.5 | 110 |
| 6 | " | 13.33 | 1.5 | 4,200 |
| 7 | " | 13.33 | 2.0 | 25,000 |
| 8 | " | 5.25 | 0.65 | — |
| 9 | " | 10.36 | 0.65 | 730 |
| 10 | " | 8.48 | 0.65 | — |
| 11 | " | 11.42 | 0.65 | — |
| 12 | " | 3.52 | 2.6 | 340 |
| 13 | " | 3.52 | 3.5 | 2,700 |
| 14 | " | 3.52 | 4.3 | 17,000 |

[1]Measured at a concentration of 0.05 g./100 ml. of decalin at 135°C.
[2]Weight percent olefin polymer of the solution
[3]Centipoises at 145°C.

Paper hand sheets were made from the resultant refined fibril product of each of these examples on a Noble and Wood sheetforming machine as was done in the previous examples. The paper hand sheets which were obtained were strong, tough and possessed good paper qualities.

EXAMPLE 15

This example is included to illustrate the fact that the centrifuge spinning apparatus 22 need not be simultaneously cooled by the use of coolant liquid flowing into the same, as by means of lines 110 and 112. The only requirement is that the outer peripheral portion of housing 60 and the area about the flails 102, comprising cavity or chamber 84, be cooled or in a cool state when the hot polymer solution is fed to the centrifuge spinning apparatus 22. Fibrils are prepared in this example by the use of a centrifuge spinning apparatus, similar to that shown at reference numeral 22 in the drawings, but without the simultaneous and continuous use of a coolant liquid pumped to the apparatus through lines 110 and 112. To accomplish this, apparatus 22 had the peripheral portion of its housing 60 and chamber 84 cooled to below 0° C. by circulating a cooling liquid through the apparatus via inlet 78 and inlet tube 80 while the apparatus including rotatable disc 86 and flails 102 were in motion. Then the flow of the coolant liquid was stopped and the remainder thereof was drained from the apparatus. Next, 200 ml. of a solution containing 0.6 weight % linear polyethylene, having an inherent viscosity of 13.33 dissolved in the substantially aliphatic hydrocarbon solvent Speedsol (boiling range 155°–180° C.) at 145° C., was introduced into the centrifuge spinning apparatus through its inlet. After passage through the rotating spinning apparatus, the polymer solution exited the same as a solvent-swollen fibrous mass. This fibrous mass when then pressed to remove excess solvent and thereafter refined by beating in a blender with 500 ml. of isopropanol. During this refining, the fibrous mass was broken down into fibrils which were recovered from the isopropanol and found to be fine, strong and suitable for making into paper.

EXAMPLES 16–28

In these examples, fibrils were prepared and refined as in Example 1, and paper sheets were formed from these fibrils in a manner identical to that followed in Example 1, with the exception that mixtures of polymers were employed in the process. Such polymer mixtures may include, in addition to the olefin polymer as described and defined hereinabove, other polymers which have been identified as diluent polymers, and which also have been described and defined hereinabove. The beginning or starting resin or polymer mixture fed to the process in each of the examples is set forth hereinbelow in Table III.

Table III

| | Ex. 16 | Ex. 17 | Ex. 18 | Ex. 19 | Ex. 20 | Ex. 21 | Ex. 22 | Ex. 23 | Ex. 24 | Ex. 25 | Ex. 26 | Ex. 27 | Ex. 28 |
|---|---|---|---|---|---|---|---|---|---|---|---|---|---|
| Wt. % low density polyethylene[1] | 75 | 40 | — | — | 40 | — | — | — | — | — | — | 25 | — |
| Wt. % linear polyethylene[2] | 25 | 60 | 25 | 60 | — | — | — | 75 | 50 | — | — | 50 | 60 |
| Wt. % linear polyethylene[3] | — | — | 75 | 40 | — | 75 | 40 | — | — | — | — | — | — |
| Wt. % linear polyethylene[4] | — | — | — | — | 60 | 25 | 60 | — | — | 75 | 50 | — | — |
| Wt. % polystyrene[5] | — | — | — | — | — | — | — | 25 | 50 | 25 | 50 | — | — |
| Wt. % | | | | | | | | | | | | | |

Table III-continued

| | Ex. 16 | Ex. 17 | Ex. 18 | Ex. 19 | Ex. 20 | Ex. 21 | Ex. 22 | Ex. 23 | Ex. 24 | Ex. 25 | Ex. 26 | Ex. 27 | Ex. 28 |
|---|---|---|---|---|---|---|---|---|---|---|---|---|---|
| polypropylene[6] | — | — | — | — | — | — | — | — | — | — | — | 25 | 40 |

[1]Low density ethylene homopolymer having a density of 0.916 and a melt index of 2.0 as determined by ASTM Test No. D1238-65 T, Condition E.
[2]Linear ethylene homopolymer having an inherent viscosity of 13.33.
[3]Linear ethylene homopolymer having an inherent viscosity of 4.6.
[4]Linear ethylene homopolymer having an inherent viscosity of 3.52.
[5]Dow Styron 666, a commercial styrene homopolymer having a melt index of 7.2 as determined by ASTM Test No. D1238-65T, Condition H.
[6]Shell Polypropylene 5120, a commercial propylene homopolymer having a melt index of 0.5 as determined by ASTM Test No. D1238-65T, Condition L.

Some of the physical properties of the sheets of these Examples 16–28, formed from the fibrils obtained in the corresponding examples, are set forth hereinbelow in Table IV.

Table IV

| | Ex. 16 | Ex. 17 | Ex. 18 | Ex. 19 | Ex. 20 | Ex. 21 | Ex. 22 | Ex. 23 | Ex. 24 | Ex. 25 | Ex. 26 | Ex. 27 | Ex. 28 |
|---|---|---|---|---|---|---|---|---|---|---|---|---|---|
| Basis Weight lbs/3 ft² | 55.66 | 42.66 | 56.93 | 55.17 | 64.46 | 52.96 | 41.70 | 44.62 | 70.05 | 58.63 | 55.56 | 47.83 | 49.69 |
| Tensile, pli | 9.22 | 9.05 | 8.19 | 11.17 | 10.29 | 8.89 | 5.58 | 3.19 | 11.48 | 11.17 | 6.06 | 5.45 | 2.91 |
| Tensile Factor pli/(lbs/3 M Ft²)/ 0.166 | 0.212 | 0.143 | 0.202 | 0.157 | 0.169 | 0.133 | 0.071 | 0.163 | 0.187 | 0.107 | 0.113 | 0.058 | |
| Stretch, % | 60.81 | 30.49 | 7.74 | 13.73 | 11.65 | 36.51 | 6.82 | 1.49 | 3.27 | 5.93 | 1.62 | 6.43 | 1.71 |
| Elmendorf Tear g/sheet | 58.0 | 73.3 | 104.6 | 134.0 | 76.6 | 44.6 | 50.0 | 52.0 | 111.3 | 55.3 | 28.6 | 100.6 | 56.0 |
| Elmendorf Tear Factor (g/sheet)/(lb/3 M Ft²) | 1.003 | 1.718 | 1.843 | 2.425 | 1.155 | 0.830 | 1.199 | 1.165 | 1.586 | 0.941 | 0.511 | 2.112 | 1.138 |
| Opacity, % | 54.93 | 63.54 | 77.59 | 74.38 | 64.99 | 51.17 | 69.18 | 79.71 | 75.77 | 60.89 | 57.85 | 85.25 | 88.9 |
| Brightness, % | 36.69 | 55.23 | 67.54 | 63.91 | 55.82 | 45.61 | 60.79 | 70.41 | 67.15 | 53.95 | 49.56 | 74.02 | 79.64 |

The following additional examples further illustrate the process of the invention in which improved fibrils are prepared and paper sheets are fabricated from these fibrils. In these examples, additional polymer mixtures including diluent polymers, as identified and defined hereinabove, are employed.

EXAMPLE 29

In this example, fibrils and paper sheets fabricated therefrom were prepared by the process set forth in Example 1. The apparatus employed and the process used in this example were identical to that used in Example 1 with the single exception that a second or additive polymer, low density polyethylene, was used and added in a minor amount to the starting hot linear polyethylene/hydrocarbon solvent solution.

The vessel used in Example 1 was charged with 3.0 liters of Speedsol solvent containing 0.018 gram of the anti-oxidant mixture of Example 1 which was then heated to 150° C. When the solvent/anti-oxidant mixture had attained this temperature, 2.25 grams of a low density polyethylene (Gulf PE 1005, a high pressure, low density polyethylene having a melt index of about 2, as determined as ASTM Test No. D1238-65T, Condition E, and a density of about 0.916) was added and dissolved. To the resulting solvent/low density polyethylene solution was added 15.0 grams of a linear high molecular weight polyethylene having an inherent viscosity of 13.33. This mixture was then held with stirring at the 150° C. temperature for a time sufficient to completely dissolve the linear polyethylene, thereby resulting in a solution suitable for the formation of fibrils by the method set forth in Example 1, and containing about 15 weight % of the low density polyethylene additive based on the weight of the linear polyethylene.

The fibrils produced after carrying out the process steps of Example 1 were used to make paper sheets on the Noble and Wood sheet-forming machine as was done in Example 1. Some of the physical properties of the resultant sheets fabricated in this example were obtained and are recorded in Table V below.

EXAMPLE 30

In this example, fibrils were prepared and refined by the methods and procedures carried out in Example 29 and paper sheets were prepared therefrom in the manner identical to that employed in Example 29 with a single exception. In this example, the additive or second polymer, low density polyethylene, was employed at a higher level. The amount of the low density polyethylene (Gulf PE 1005; melt index of 2 and density of 0.916) used was increased from 2.25 grams up to 3.75 grams. The resulting solvent/low density polyethylene/linear high molecular weight polyethylene solution contained about 25 weight % of the low density polyethylene additive based on the weight of the linear polyethylene. Fibrils were produced by the methods set forth in Examples 1 and 29 and then paper sheets were prepared therefrom. The physical properties of the resultant sheets fabricated on the Noble and Wood sheet-forming machine were determined and are recorded in Table V.

A number of the physical properties of the paper sheets produced in Examples 29 and 30 were obtained and calculated by standard test procedures. The physical properties obtained from the results of these tests run on the papers were recorded and are reported hereinbelow in Table V as follows:

Table V

| Property* | Example 29 | Example 30 |
|---|---|---|
| Basis Weight, lbs./3000 ft.² | 50.14 | 52.02 |
| Tensile Strength, pli | 13.14 | 14.10 |
| Tensile Factor | 0.26 | 0.27 |
| Stretch, % | 45.60 | 59.96 |

Table V-continued

| Property* | Example 29 | Example 30 |
|---|---|---|
| Mullen Burst Strength, psi | 37.0 | 39.0 |
| Mullen Burst Factor | 0.70 | 0.76 |
| Elmendorf Tear, g./sheet | 143.3 | 155.3 |
| Elmendorf Tear Factor | 2.80 | 2.93 |
| Fold Endurance, cycles to break | >10,000 | >10,000 |
| Opacity, % | 90.0 | 87.0 |
| Brightness, % | 73.5 | 73.0 |

*Tappi Procedure No. T220 M-60

EXAMPLE 31

In this example, fibrils and paper sheets fabricated therefrom were prepared by the process set forth in Example 1. The apparatus employed and the process used in this example was identical to that used in Example 1 with the single exception that a second or additive polymer, polystyrene, was used and added in a minor amount to the starting hot polyethylene/hydrocarbon solvent solution.

The vessel used in Example 1 was charged with 3.0 liters of Speedsol solvent containing 0.018 grams of the anti-oxidant mixture of Example 1 which was then heated to 150° C. When the solvent/anti-oxidant mixture had attained this temperature, 1.5 grams of polystyrene (Dow Styron 666, a commercial polystyrene) was added and dissolved. To the resulting solvent-polystyrene solution was added 15.0 grams of a linear high molecular weight polyethylene having an inherent viscosity of 13.33. This mixture was then held with stirring at the 150° C. temperature for a time sufficient to completely dissolve the polyethylene, thereby resulting in a solution suitable for the formation of fibrils by the method set forth in Example 1, and containing about 10 weight percent of the polystyrene additive based on the weight of the linear polyethylene. The fibrils produced after carrying out the process steps of Example 1 were used to make paper sheets on the Noble and Wood sheet-forming machine as was done in Example 1. Some of the physical properties of the resultant sheets fabricated in this example were obtained and are recorded in Table VI below.

EXAMPLE 32

In this example, fibrils were prepared and refined by the methods and procedures carried out in Example 31 and paper sheets were prepared therefrom in the manner identical to that employed in Example 31 with a single exception. In this example, the additive or second polymer, polystyrene, was employed at a higher level. The amount of the polystyrene (Dow Styron 666, a commercial polystyrene) used was increased from 1.5 grams up to 3.0 grams. The resulting solvent/polystyrene/linear high molecular weight polyethylene solution contained about 20 weight % of the polystyrene additive based on the weight of the linear polyethylene. Fibrils were produced by the methods set forth in Examples 1 and 31 and then paper sheets were prepared therefrom. The physical properties of the resultant sheets fabricated on the Noble and Wood sheet-forming machine were determined and are recorded in Table VI.

A number of the physical properties of the paper sheets produced in Examples 31 and 32 were obtained and calculated by standard test procedures. The physical properties obtained from the results of these tests run on the papers were recorded and are reported hereinbelow in Table VI as follows:

Table VI

| Property* | Example 31 | Example 32 |
|---|---|---|
| Basis Weight, lbs./3000 ft.² | 48.37 | 53.25 |
| Tensile Strength, pli | 11.53 | 13.03 |
| Tensile Factor | 0.23 | 0.24 |
| Stretch, % | 30.90 | 27.00 |
| Mullen Burst Strength, psi | 37.2 | 26.7 |
| Mullen Burst Factor | 0.72 | 0.70 |
| Elmendorf Tear, g./sheet | 204.0 | 258.0 |
| Elmendorf Tear Factor | 4.13 | 4.78 |
| Fold Endurance, cycles to break | >10,000 | >10,000 |
| Opacity, % | 84.5 | 82.2 |
| Brightness, % | 74.3 | 76.4 |

*Tappi Procedure No. T220 M-60

EXAMPLE 33

In this example, fibrils were prepared and refined as in Example 31 and paper sheets were formed from these fibrils in a manner identical to that followed in Example 31 with one exception. The exception is that the amount of the additive or second polymer, polystyrene, employed was used in an amount of 2.5 grams dissolved in 2.0 liters of the Speedsol solvent. To the solvent/polystyrene solution was added 10.0 grams of the linear high molecular weight polyethylene of Example 31 to result in a solution suitable for the formation of fibrils by the method set forth in Example 1, and containing about 25 weight % of the polystyrene additive based on the weight of the linear polyethylene. Fibrils were then produced by carrying out the remainder of the process steps set forth in Example 1 and the resultant fibrils were used to make paper sheets on the Noble and Wood sheet-forming machine as was done in Example 1. The resulting paper sheets were similar to those produced in Examples 31 and 32.

EXAMPLE 34

In this example, fibrils and paper sheets fabricated therefrom were prepared by the process set forth in Example 1. The apparatus employed and the process used in this example was identical to that used in Example 1 with the single exception that a second or additive polymer, polypropylene, was used and added in a minor amount to the starting hot polyethylene/hydrocarbon solvent solution.

The vessel used in Example 1 was charged with 3.0 liters of Speedsol solvent containing 0.018 gram of the anti-oxidant mixture of Example 1 which was then heated at 150° C. When the solvent/anti-oxidant mixture had attained this temperature, 3.75 grams of a propylene homopolymer, having an inherent viscosity of approximately 5.0 and containing 23% heptane extractables, was added and dissolved. To the resulting solvent/polypropylene solution was added 15.0 grams of a linear high molecular weight polyethylene having an inherent viscosity of 13.33. This mixture was then held with stirring at the 150° C. temperature for a time sufficient to completely dissolve the polyethylene, thereby resulting in a solution suitable for the formation of fibrils by the method set forth in Example 1, and containing about 25 weight % of the polypropylene additive based on the weight of the linear polyethylene. The fibrils produced after carrying out the process steps of Example 1 were used to make paper sheets on the Noble and Wood sheet-forming machine as was done in Example 1. Some of the physical properties of the resultant sheets fabricated in this example were obtained and are recorded in Table VII below.

Table VII

| Property* | Example 34 | Example 35 | Example 36 |
|---|---|---|---|
| Basis Weight, lbs./3000 ft.² | 43.62 | 53.19 | 47.44 |
| Tensile Strength, pli | 6.40 | 12.75 | 11.01 |
| Tensile Factor | 0.15 | 0.23 | 0.22 |
| Stretch, % | 18.96 | 61.05 | 56.73 |
| Mullen Burst Strength, psi | 25.6 | 38.5 | 32.5 |
| Mullen Burst Factor | 0.55 | 0.70 | 0.71 |
| Elmendorf Tear, g./sheet | 168.00 | 196.6 | 204.6 |
| Elmendorf Tear Factor | 3.90 | 3.59 | 4.06 |
| Fold Endurance, cycles to break | 1,128 | >10,000 | >10,000 |
| Opacity, % | 79.2 | 88.9 | 88.1 |
| Brightness, % | 74.8 | 77.4 | 75.7 |

*Tappi Procedure No. T220 M-60

EXAMPLE 35

In this example, fibers were prepared and refined by the methods and procedures carried out in Example 34 and paper sheets were prepared therefrom in the manner identical to that employed in Example 34 with a single exception. In this example, the additive or second polymer employed was a different propylene homopolymer and was employed at a lower level. The polypropylene used had a melt index of 7.0 as determined by ASTM Test No. D1238-65T, Condition E, and was employed in an amount of 3.0 grams. The resultant solvent/propylene/linear high molecular weight polyethylene solution contained approximately 20 weight % of the propylene additive based on the weight of the linear polyethylene. Fibrils were then produced by the methods set forth in Examples 1 and 34 and thereafter paper sheets were prepared therefrom. The physical properties of the resultant sheets fabricated on the Noble and Wood sheet-forming machine were determined and are recorded hereinbelow in Table VII.

EXAMPLE 36

In this example, fibrils were prepared and refined by the methods and procedures carried out in Example 34 and paper sheets were then fabricated therefrom in the manner identical to that employed in Example 34 with a single exception. In this example, the additive or second polymer employed was a different propylene polymer and was employed at yet a lower level. The propylene polymer used was a propylene copolymer having a melt index of 3.5 as determined by ASTM Test No. D1238-65T, Condition E. containing 4.3 weight % polymerized ethylene and was employed in an amount of 2.0 grams. The resultant solvent/propylene copolymer/linear high molecular weight polyethylene solution contained about 13.33 weight % of the propylene copolymer additive based on the weight of the linear polyethylene. Fibrils were then produced from this solution by the methods set forth in Examples 1 and 34 and thereafter paper sheets were prepared from the resultant fibrils. The physical properties of the resulting sheets fabricated on the Nobel and Wood sheet-forming machine were determined and are recorded below in Table VII.

A number of the physical properties of the paper sheets produced in Examples 34, 35 and 36 were obtained and calculated by standard test procedures. The physical properties obtained from the results of these tests run on the papers were recorded and are reported hereinbelow in Table VII as follows:

EXAMPLE 37

In this example, fibrils were prepared and refined as in Example 34 and paper sheets were formed from these fibrils in the manner identical to that followed in Example 34 with one exception. The exception is that the amount of the additive or second polymer, polypropylene, was used in an amount of 2.5 grams dissolved in 2.0 liters of the Speedsol solvent. The polypropylene employed was a homopolymer of propylene having an inherent viscosity of 8.7 and an isotacticity of 97.7%. To the solvent/polypropylene solution was added 10.0 grams of the linear high molecular weight polyethylene of Example 34 to result in a solution suitable for the formation of fibrils by the method set forth in Example 1, and containing about 25 weight % of the polypropylene additive based on the weight of the linear polyethylene. Fibrils were then produced by carrying out the remainder of the process steps set forth in Example 1 and the resultant fibrils were used to make paper sheets on the Noble and Wood sheet-forming machine as was done in Example 1. The resultant paper sheets were similar to those produced in Examples 34, 35 and 36.

Water dispersibility studies for the fibrils produced in Example 1 and some of the following examples were undertaken and results thereof are set forth hereinbelow in Table IX. The dispersibility in water of the fibrils obtained in the examples was checked by dispersing 3.0 grams (weight of a squeezed but not dried sample of the fibrils) of a pulp of the fibrils in 250 milliliters of water in a Waring blender.

The fibril pulp derived from purely linear high molecular polyethylene without any additives or modifiers (Example 1) is almost completely unwet and the essentially dry fibril pulp floats on the surface of the water in a Waring blender. The varying degrees of improvement attained with the various modifiers or additives of the invention are readily apparent when fibril pulp samples of the same were dispersed as above in 250 milliliters of water in a Waring blender.

In order to attain some numerical comparisons of the dispersibility of the fibril pulp obtained from the various blends of high molecular weight linear polyethylene and other polymers or diluent polymers, the water and pulp suspension obtained in the Waring blender for each of the examples studied was transferred to a 250 milliliter graduated cylinder and the water level adjusted to 250 milliliters. If there was any of the substantially dry fibrils in the pulp, the approximate fraction of the substantially dry fibril material was noted and is recorded hereinbelow in Table IX. As can be noted from the table substantially dry fibrils within the pulp remain only with the poorest of blends or when the lowest amounts of the additive or modifying polymers are employed.

The next step in the dispersibility study was to vigorously shake the suspension in the graduated cylinder and thereafter note and record the volume occupied within the graduated cylinder by the wet pulp after time invervals of 30 second, 60 seconds and 10 minutes. The values observed and recorded are reported hereinbelow in Table IX.

Yet another measure of the fibril pulp's dispersibility undertaken in these water dispersibility studies was that of the rise time of the fibril pulp. The rise time of the fibril pulp was observed and recorded at two different levels within the 250 milliliter graduated cylinder after the suspension therein had been vigorously shaken. The two levels within the graduated cylinder at which the times were observed and recorded were the 100 milliliter level and the 80 milliliter level. The time required for the wet pulp volume within the graduated cylinder to reach or decrease to the 100 milliliter level and also to the 80 milliliter level of the cylinder were recorded and are reported hereinbelow in Table IX.

EXAMPLE 38

In this example, fibrils and paper sheets fabricated therefrom were prepared by the process set forth in Example 1. The apparatus employed and the process used in this example were identical to that used in Example 1 with the exception that an additive polymer, a maleic anhydride copolymer, was used and added in a minor amount to the starting hot polyethylene/hydrocarbon solvent solution.

The vessel used in Example 1 was charged with 3.0 liters of xylene (the Speedsol solvent used in Example 1 was replaced with xylene in this example as the solvent for the beginning or starting solution) containing 0.018 gram of the anti-oxidant mixture of Example 1 which was then heated to 135° C. When the solvent/antioxidant mixture had attained this temperature, 1.5 grams of a 1:1 molar ratio of a copolymer of maleic anhydride and tetradecene (a $C_{14}$ mono-1-olefin) having a molecular weight of approximately 20,000 was added and dissolved. To the resulting xylene/maleic anhydride copolymer solution was added 15.0 grams of a linear high molecular weight polyethylene having an inherent viscosity of 13.33. This mixture was then held with stirring at 135° C. temperature for a time sufficient to completely dissolve the polyethylene, thereby resulting in a solution suitable for the formation of fibrils by the method set forth in Example 1, and containing about 10 weight percent of the maleic anhydride copolymer additive based on the weight of the linear polyethylene. Water dispersibility studies were carried out on the fibrils produced in this example by the method set forth above (as was done with the fibrils of Example 1) and these fibrils were used to make paper sheets on the Noble and Wood sheet-forming machine as was done in Example 1. Some of the physical properties of the resultant sheets fabricated in this example were obtained and are recorded in Table VIII below, and the data collected in the water dispersibility studies are reported in the following Table IX.

EXAMPLE 39

In this example, fibrils were prepared and refined by the methods and procedures carried out in Examples 1 and 38 and paper sheets were prepared therefrom in the manner identical to that employed in Examples 1 and 38 with a single exception. In this example, the additive or modifying copolymer employed was a different maleic anhydride copolymer and was employed at a higher level or concentration. The maleic anhydride copolymer used was a 1:1 molar ratio of maleic anhydride and octadecene 8a $C_{18}$ mono-1-olefin) having a molecular weight of about 19,000 and was employed in an amount of 3.0 grams in 3.0 liters of the Speedsol solvent of Example 1. The resultant Speedsol solvent/maleic anhydride copolymer/linear high molecular weight polyethylene solution contained approximately 20 weight % of the maleic anhydride copolymer additive based on the weight of the linear polyethylene. Fibrils were then produced by the method set forth in Examples 1 and 38, water dispersibility studies were carried out by the method set forth above, and paper sheets were prepared from the fibrils as was done in Example 1 and 38. The physical properties of the resultant sheets fabricated on the Noble and Wood sheet-forming machine were determined and are recorded hereinbelow in Table VIII, and the data collected in the water dispersibility studies are reported in the following Table IX.

EXAMPLE 40

In this example, fibrils were prepared and refined in a manner identical to that carried out in Example 39 with the single exception that the maleic anhydride copolymer was used at a lower level or concentration. The maleic anhydride/octadecene copolymer was employed in an amount of 1.5 grams to thereby result in a solvent/maleic anhydride copolymer/linear high molecular weight polyethylene solution containing approximately 10 weight % of the maleic anhydride copolymer additive based on the weight of the linear polyethylene. Fibrils were then produced from this solution by the method set forth in Examples 1 and 38, water dispersibility studies were carried out by the method set forth above, and paper sheets were prepared from the fibrils as was done in Examples 1 and 38. The results of the water dispersibility studies were recorded and are set forth hereinbelow in Table IX.

EXAMPLE 41

In this example, fibrils were prepared and refined by the methods and procedures carried out in Example 39 and paper sheets were prepared therefrom in the same fashion as that used in Example 39 with the single exception being that maleic anhydride/octadecene copolymer was employed at yet a lower level or concentration. The maleic anhydride/octadecene copolymer was used in an amount of 0.75 gram whereby the resultant solvent/maleic anhydride copolymer/linear high molecular weight polyethylene solution contained approximately 5 weight % of the maleic anhydride copolymer additive based on the weight of the linear polyethylene. Fibrils were produced from this solution by the procedures set forth by the method set forth above, water dispersibility studies were carried out on the resultant fibrils as in Examples 1 and 38, and paper sheets were prepared from the fibrils produced as was done in Examples 1 and 38. The results of the water dispersibility studies are recorded in Table IX set forth hereinbelow.

EXAMPLE 42

In this example, fibrils were prepared and refined by the methods and procedures carried out in example 18 and paper sheets were prepared therefrom in the manner identical to that employed in Example 38 with one exception. The exception is that the additive or modifying copolymer of maleic anhydride and tetradecene was employed at a higher level or concentration than that used in Example 38. The maleic anhydride/tetradecene copolymer employed had a molecular weight of about 20,000 and was used in an amount of 3.0 grams. The resultant xylene/maleic anhydride copolymer/linear high molecular weight polyethylene solution contained about 20 weight % of the maleic anhydride copolymer additive based on the weight of the linear polyethylene. Fibrils were thereafter produced from this solution by the process set forth in Examples 1 and 38, water dispersibility studies were carried out in the resultant fibrils by the method set forth above, and paper sheets were prepared from the fibrils produced as was done in Examples 1 and 38. The results of the water dispersibility studies are set forth hereinbelow in Table IX.

EXAMPLE 43

In this example, fibrils were prepared and refined in a manner identical to that employed in Example 38 with the exception that the modifying copolymer was employed at a lower level or concentration. The maleic anhydride/tetradecene copolymer of Example 38 was used in an amount of 0.75 gram and the dissolving was carried out at 135° C. in the xylene solvent. The resultant solvent/maleic anhydride copolymer/linear high molecular weight polyethylene solution contained approximately 5 weight % of the maleic anhydride copolymer additive based on the weight of the linear polyethylene. Fibrils were then produced by the method set forth in Examples 1 and 38, water dispersibility studies were carried out on the resultant fibrils by the method set forth above, and paper sheets were fabricated from the fibrils produced as was done in Examples 1 and 38. The results recorded in the water dispersibility studies are reported in Table IX which follows.

EXAMPLE 44

Fibrils were prepared and refined by the methods and procedues carried out in Example 38 and paper sheets were prepared therefrom in a manner identical to that employed in Example 38 with the exception that the additive or modifying copolymer employed was a different maleic anhydride copolymer. The maleic anhydride copolymer used was a 1:1 molar ratio of maleic anhydride and decene (a $C_{10}$ mono-1-olefin) having a molecular weight of approximately 18,000 which was employed in an amount of 1.5 grams. The resultant solvent/maleic anhydride copolymer/linear high molecular weight polyethylene solution containing about 10 weight % of the maleic anhydride copolymer additive based on the weight of the linear polyethylene. Fibrils were then produced from this solution by the processes set forth in Examples 1 and 38, water dispersibility studies were undertaken and carried out on the fibrils by the method set forth above, and paper sheets were fabricated from the resultant fibrils as was done in Examples 1 and 38. The physical properties of the paper sheets fabricated on the Noble and Wood sheet-forming machine were determined and are reported in the following Table VIII, and data collected in the water dispersibility studies were recorded and are set forth hereinbelow in Table IX.

EXAMPLE 45

The above Example 44 was repeated using 0.75 grams of the maleic anhydride/decene copolymer thereof, whereby the resultant xylene/maleic anhydride copolymer/linear high molecular weight polyethylene solution contained approximately 5 weight % of the maleic anhydride copolymer additive based on the weight of the linear polyethylene. The physical properties of the paper sheets fabricated on the Noble and Wood sheet-forming machine were determined and are reported in the following Table VIII, and the data collected in the water dispersibility studies were recorded and are set forth hereinbelow in Table IX.

EXAMPLE 46

In this example, fibrils were prepared and refined in a fashion similar to that employed in Example 38 with the exception that tetralin was substituted for the xylene solvent, and with the further exception that a different maleic anhydride copolymer was used and was employed at a higher level or concentration. The maleic anhydride copolymer used was a 1:1 molar ratio of maleic anhydride and hexene (a $C_6$ mono-1-olefin) having a molecular weight of about 22,000 and was employed in the amount of 3.0 grams. The dissolving of the linear high molecular weight polyethylene in the tetralin solvent was carried out at 160° C. The resulting solvent/maleic anhydride copolymer/linear high molecular weight polyethylene solution contained approximately 20 weight % of the maleic anhydride copolymer additive based on the weight of the linear polyethylene. Fibrils were thereafter produced by the method set forth in Examples 1 and 38, water dispersibility studies of the fibrils were undertaken by the method set forth above, and paper sheets were fabricated from the resultant fibrils as was done in Examples 1 and 38. The physical properties of the resultant sheets prepared on the Noble and Wood sheet-forming machine were determined and are set forth hereinbelow in Table VIII and the results of the water dispersibility studies are recorded in the following Table IX.

EXAMPLE 47

Example 46, above, was repeated using a 1.5 grams of the maleic anhydride/hexene copolymer thereof, whereby the resulting tetralin/maleic anhydride copolymer/linear high molecular weight polyethylene solution containing about 10 weight % of the maleic anhydride copolymer additive based on the weight of the linear polyethylene. The physical properties of the resultant sheets prepared on the Noble and Wood sheet-forming machine were determined and are set forth hereinbelow in Table VIII and the results of the water dispersibility studies are recorded in the following Table IX.

EXAMPLE 48

Fibrils were prepared and refined in a manner similar to that employed in Example 38 with the exception that a different maleic anhydride copolymer was employed. The maleic anhydride copolymer employed was a 3:1 molar ratio of styrene and maleic anhydride having a molecular weight of approximately 1600 and was used in an amount of 3.0 grams. The linear high molecular weight polyethylene was dissolved in the xylene solvent at a temperature of about 135° C. and the resultant xylene/maleic anhydride copolymer/linear high molecular weight polyethylene solution containing approximately 20 weight % of the styrene/maleic anhydride copolymer additive based on the weight of the linear polyethylene. Fibrils were then produced from this solution by the method set forth in Examples 1 and 38, water dispersibility studies were carried out on the fibrils by the method set forth above, and paper sheets were prepared from the fibrils produced as was done in Examples 1 and 38. The data collected in the water dispersibility studies are reported in Table IX which follows.

Table VIII

| Property* | Example 38 | Example 39 | Example 44 | Example 45 | Example 46 | Example 47 |
|---|---|---|---|---|---|---|
| Basis Weight lbs./3000 ft.² | 52.35 | 55.38 | 54.18 | 53.26 | 54.34 | 51.64 |
| Tensile Strength, pli | 10.41 | 12.12 | 12.38 | 9.50 | 11.49 | 8.85 |
| Tensile Factor | 0.20 | 0.22 | 0.23 | 0.18 | 0.21 | 0.17 |
| Stretch, % | 18.31 | 35.65 | 30.32 | 12.22 | 22.51 | 14.97 |
| Mullen Burst Strength, psi | 29.3 | 33.2 | 34.8 | 28.2 | 33.1 | 26.8 |
| Mullen Burst Factor | 0.57 | 0.60 | 0.64 | 0.53 | 0.60 | 0.50 |
| Elmendorf Tear, g./sheet | 203.3 | 193.3 | 216.0 | 195.3 | 263.3 | 198.3 |
| Elmendorf Tear Factor | 3.87 | 3.48 | 3.99 | 3.68 | 4.87 | 3.70 |
| Fold Endurance, cycles to break | >10,000 | >10,000 | >10,000 | >10,000 | >10,000 | >10,000 |
| Opacity, % | 80.6 | 77.6 | 79.4 | 81.0 | 80.3 | 79.7 |
| Brightness, % | 71.0 | 61.4 | 68.5 | 72.6 | 71.3 | 70.7 |

Table IX

| Ex. | % Dry Fibrils on Water Surface | Volume (ml) of Wet Fibrils After | | | Time (sec) Required for Volume of Wet Fibrils to Decrease to | |
|---|---|---|---|---|---|---|
| | | 30 sec. | 60 sec. | 10 min. | 100 ml. | 80 ml. |
| 1 | 90 | 5 | 5 | 5 | <1 | <1 |
| 38 | none | 100 | 90 | 70 | 25 | 300 |
| 39 | none | 90 | 85 | 70 | 17 | 180 |
| 40 | none | 90 | 85 | 80 | 15 | 360 |
| 41 | none | 95 | 90 | 75 | 20 | 180 |
| 42 | none | 115 | 110 | 90 | 90 | >900 |
| 43 | 5 | 55 | 50 | 50 | 3 | 5 |
| 44 | none | 105 | 100 | 90 | 100 | >900 |
| 45 | trace | 70 | 70 | 60 | 2 | 3 |
| 46 | none | 105 | 100 | 95 | 60 | >900 |
| 47 | trace | 85 | 80 | 75 | 5 | 60 |
| 48 | 33 | 30 | 30 | 30 | 2 | 3 |

EXAMPLE 49

In this example, fibrils and paper sheets fabricated therefrom were prepared by the process set forth in Example 1. The apparatus employed and the process used in this example were identical to that used in Example 1 with the single exception that an additive or modifying copolymer, an ethylene copolymer, was used and added in a minor amount to the starting hot polyethylene/hydrocarbon solvent solution.

The vessel used in Example 1 was charged with 3.0 liters of Speedsol solvent containing 0.018 gram of the anti-oxidant mixture of Example 1 which was then heated to 150° C. When the solvent/anti-oxidant mixture had attained this temperature, 3.75 grams of an ethylene copolymer, having a melt index of 2.0 (as determined by ASTM Test No. D1238-65T, Condition E) and containing 18 weight % based on the weight of the copolymer of polymerized methyl acrylate, was added and dissolved. To the resulting solvent/ethylene copolymer solution was added 15.0 grams of a linear high molecular weight polyethylene having an inherent viscosity of 13.33. This mixture was then held with stirring at the 150° C. temperature for a time sufficient to completely dissolve the polyethylene, thereby resulting in a solution suitable for the formation of fibrils by the method set forth in Example 1, and containing about 25 weight % of the ethylene copolymer additive based on the weight of the linear polyethylene. The fibrils produced after carrying out the process steps of Example 1 were used to make paper sheets on the Noble and Wood sheet-forming machine as was done in Example 1. Some of the physical properties of the resultant sheets fabricated is this example were obtained and are recorded in Table X below.

EXAMPLE 50

In this example, fibrils were prepared and refined by the methods and procedures carried out in Example 49 and paper sheets were prepared therefrom in the manner identical to that employed in Example 49 with a single exception. In this example, the additive polymer employed was a different ethylene copolymer and was employed at a lower level. The ethylene copolymer used contained 23 weight % polymerized methyl acrylate, had a melt index of 3.2 as determined by ASTM Test No. D1238-65T, Condition E, and was employed in an amount of 3.0 grams. The resultant solvent/ethylene copolymer/linear high molecular weight polyethylene solution contained approximately 20 weight % of the ethylene copolymer additive based on the weight of the linear polyethylene. Fibrils were then produced by the methods set forth in Examples 1 and 49 and thereafter paper sheets were prepared therefrom. The physical properties of the resultant sheets fabricated on the Noble and Wood sheet-forming machine were determined and are recorded hereinbelow in Table X.

EXAMPLE 51

In this example, fibrils were prepared and refined by the methods and procedures carried out in Example 49 and paper sheets were then fabricated therefrom in the manner identical to that employed in Example 49 with a single exception. In this example, the additive polymer employed was a different ethylene copolymer and was employed at a lower level. The ethylene copolymer used had a melt index of 6.0 as determined by ASTM Test No. D1238-65T, Condition E, contained 40 weight % polymerized methyl acrylate, and was employed in an amount of 3.0 grams. The resultant solvent/ethylene copolymer/linear high molecular weight polyethylene solution contained about 20 weight % of the ethylene copolymer additive based on the weight of the linear polyethylene. Fibrils were then produced from this solution by the methods set forth in Examples 1 and 49 and thereafter paper sheets were prepared from the resultant fibrils. The physical properties of the resulting sheets fabricated on the Noble and Wood sheet-forming machine were determined and are recorded below in Table X.

EXAMPLE 52

In this example, fibrils were prepared and refined by the methods and procedures carried out in Example 49 and paper sheets were prepared therefrom in the manner identical to that employed in Example 49 with a single exception. In this example, the additive polymer employed was a different ethylene copolymer and was employed at a lower level. The ethylene copolymer used contained 24 weight % polymerized methyl methacrylate, had a melt index of 8.0 as determined by ASTM Test No. D1238-65T, Condition E, and was employed in an amount of 3.0 grams. The resultant solvent/ethylene copolymer/linear high molecular weight polyethylene solution contained approximately 20 weight % of the ethylene copolymer additive based on the weight of the linear polyethylene. Fibrils were then produced by the methods set forth in Examples 1 and 49 and thereafter paper sheets were prepared therefrom. The physical properties of the resultant sheets fabricated on the Noble and Wood sheet-forming machine were determined and are recorded hereinbelow in Table X.

EXAMPLE 53

In this example, fibrils were prepared and refined by the methods and procedures carried out in Example 49 and paper sheets were then fabricated therefrom in the manner identical to that employed in Example 49 with a single exception. In this example, the additive polymer employed was a different ethylene copolymer and was employed at yet a lower level. The ethylene copolymer used had a melt index of 1,000 as determined by ASTM Test No. D1238-65T, Condition E, contained 41 weight % polymerized methyl methacrylate, and was employed in an amount of 1.5 grams. The resultant solvent/ethylene copolymer/linear high molecular weight polyethylene solution contained about 10 weight % of the ethylene copolymer additive based on the weight of the linear polyethylene. Fibrils were then produced from this solution by the methods set forth in Examples 1 and 49 and thereafter paper sheets were prepared from the resultant fibrils. The physical properties of the resulting sheets fabricated on the Noble and Wood sheet-forming machine were determined and are recorded below in Table X.

EXAMPLE 54

The above Example 49 was repeated using 3.0 grams of an ethylene copolymer containing 18 weight % polymerized ethyl acrylate and having a melt index of 6.0 as determined by ASTM Test No. D1238-65T, Condition E. The resultant solvent/ethylene copolymer/linear high molecular weight polyethylene solution contained approximately 20 weight % of the ethylene copolymer based on the weight of the linear polyethylene. The physical properties of the paper sheets fabricated on the Noble and Wood sheet-forming machine were determined and are reported in the following Table X.

EXAMPLE 55

In this example, fibrils were prepared and refined by the methods and procedures carried out in Example 49 and paper sheets were then fabricated therefrom in the manner identical to that employed in Example 49 with a single exception. In this example, the additive or modifying polymer employed was a different ethylene copolymer and was employed at a lower level. The ethylene copolymer used had a melt index of 3.1 as determined by ASTM Test No. D1238-65T, Condition E, contained 10.5 weight % polymerized vinyl acetate, and was employed in an amount of 3.0 grams. The resultant solvent/ethylene copolymer/linear high molecular weight polyethylene solution contained approximately 20 weight % of the ethylene copolymer additive based on the weight of the linear polyethylene. Fibrils were then produced from this solution by the methods set forth in Examples 1 and 49 and thereafter paper sheets were prepared from the resultant fibrils. The physical properties of the resultant sheets fabricated on the Noble and Wood sheet-forming machine were determined and are recorded below in Table X.

EXAMPLE 56

Example 49 above was repeated using 310 grams of an ethylene copolymer containing 3.1 weight % polymerized vinyl acetate and having a melt index of 1.9 as determined by ASTM Test No. D1238-65T, Condition E. The resulting solvent/ethylene copolymer/linear high molecular weight polyethylene solution contained 20 weight % of the ethylene copolymer additive based on the weight of the linear polyethylene. The physical properties of the resultant sheets prepared on the Noble and Wood sheet-forming machine were determined and are set forth hereinbelow in Table X.

EXAMPLE 57

Fibrils were prepared and refined by the methods and procedures carried out in Example 49 and paper sheets were prepared therefrom in a manner identical to that employed in Example 49 with the exception that the additive or modifying copolymer employed was a different ethylene copolymer. The ethylene copolymer used contained 33 weight % polymerized vinyl acetate, had a melt index of 26.0 as determined by ASTM Test No. D1238-65T, Condition E, and was employed in the amount of 3.0 grams. The resultant solvent/ethylene copolymer/linear high molecular weight polyethylene solution contained 20 weight % of the ethylene copolymer additive based on the weight of the linear polyethylene. Fibrils were then produced from this solution by the processes set forth in Examples 1 and 49 and paper sheets were fabricated from the resultant fibrils as was done in Examples 1 and 49. The physical properties of the paper sheets fabricated on the Noble and Wood sheet-forming machine was determined and are recorded in Table X.

EXAMPLE 58

The above Example 49 was repeated using 1.5 grams of an ethylene copolymer containing 30 weight % polymerized isopropyl acrylate and having a melt index of 1.0 as determined by ASTM Test No. D1238-65T, Condition E. The resultant solvent/ethylene copolymer/linear high molecular weight polyethylene solution contained 10 weight percent of the ethylene copolymer additive based on the weight of the linear polyethylene. The physical properties of the paper sheets fabricated on the Noble and Wood sheet-forming machine were determined and are reported in the following Table X.

A number of the physical properties of the paper sheets produced in the above Examples 49–58 were obtained and calculated by standard test procedures. The physical properties obtained from the results of these tests run on the papers were recorded and are reported hereinbelow in Table X as follows:

Table X

| Property* | Ex. 49 | Ex. 50 | Ex. 51 | Ex. 52 | Ex. 53 | Ex. 54 | Ex. 55 | Ex. 56 | Ex. 57 | Ex. 58 |
|---|---|---|---|---|---|---|---|---|---|---|
| Basis Weight, lbs./3000 ft.² | 48.83 | 60.25 | 64.93 | 54.21 | 54.70 | 51.80 | 57.39 | 53.89 | 53.28 | 51.85 |
| Tensile strength, pli | 8.95 | 16.22 | 18.40 | 15.39 | 16.95 | 15.88 | 13.06 | 15.06 | 15.38 | 12.97 |
| Tensile Factor | 0.20 | 0.26 | 0.28 | 0.28 | 0.30 | 0.30 | 0.22 | 0.27 | 0.28 | 0.25 |
| Stretch, % | 30.33 | 71.98 | 95.17 | 76.40 | 79.04 | 88.37 | 57.38 | 68.04 | 73.90 | 65.48 |
| Mullen Burst Strength, psi | 26.6 | 42.3 | 46.8 | 40.3 | 46.3 | 40.3 | 35.9 | 40.1 | 41.8 | 38.9 |
| Mullen Burst Factor | 0.57 | 0.71 | 0.73 | 0.78 | 0.83 | 0.79 | 0.65 | 0.73 | 0.75 | 0.73 |
| Elmendorf Tear, g./sheet | 135.3 | 151.3 | 198.0 | 152.0 | 196.5 | 162.0 | 170.8 | 180.0 | 167.3 | 182.0 |
| Elmendorf Tear Factor | 2.85 | 2.47 | 3.01 | 2.66 | 3.48 | 3.05 | 2.89 | 3.25 | 3.01 | 3.48 |
| Fold Endurance, cycles to break | >10,000 | >10,000 | >10,000 | >10,000 | >10,000 | >10,000 | >10,000 | >10,000 | >10,000 | >10,000 |
| Opacity, % | 77.2 | 79.7 | 83.1 | 78.4 | 83.4 | 85.4 | 92.4 | 84.0 | 87.0 | 80.4 |
| Brightness, % | 72.0 | 64.5 | 67.8 | 60.7 | 68.3 | 67.3 | 76.5 | 66.6 | 68.7 | 66.9 |

*Tappi Procedure No. T220 M-60

EXAMPLE 59

The above Example 52 was repeated using 11.1 grams of the ethylene copolymer thereof, and 12.0 grams of the linear high molecular weight polyethylene having an inherent viscosity of 13.33 (the same linear polyethylene as used in Examples 1 and 49). The resultant Speedsol solvent/ethylene copolymer/linear high molecular weight polyethylene solution contained approximately 92 weight % of the ethylene copolymer additive based on the weight of the linear polyethylene. The paper sheets fabricated on the Noble and Wood sheet-forming machine were similar to those produced in the above examples (49–58) and exhibited the same quality and grade evident in the other paper sheets produced in those examples.

EXAMPLE 60

Example 57 above was repeated using 11.1 grams of the ethylene copolymer thereof, and 12.0 grams of the linear high molecular weight polyethylene having an inherent viscosity of 13.33 (the same linear polyethylene as used in Examples 1 and 49). The resulting Speedsol solvent/ethylene copolymer/linear high molecular weight polyethylene solution contained about 92 weight percent of the ethylene copolymer additive based on the weight of the linear polyethylene. The paper sheets produced on the Noble and Wood sheet-forming machine were similar to those produced in the above examples (49–58) and exhibited the same quality and grade evident in the other paper sheets fabricated in those examples.

EXAMPLE 61

In this example, fibrils were prepared and refined as in Example 49 and paper sheets were formed from these fibrils in the manner identical to that followed in Example 49 with one exception. The exception is that the additive or second polymer, an ethylene copolymer, was used in an amount of 1.0 grams dissolved in 2.0 liters of the Speedsol solvent. The additive polymer employed was an ethylene copolymer having a melt index of 2.0 as determined by ASTM Test No. D1238-65T, Condition E, and contained 18 weight percent polymerized methyl acrylate. To the solvent/ethylene copolymer solution was added 10.0 grams of the linear high molecular weight polyethylene of Example 49 to result in a solution suitable for the formation of fibrils by the method set forth in Examples 1 and 49 and containing about 10 weight % of the ethylene copolymer additive based on the weight of the linear polyethylene. Fibrils were then produced by carrying out the remainder of the process steps set forth in Example 1 and the resultant fibrils were used to make paper sheets on the Noble and Wood sheet-forming machine as was done in Example 1. The resultant paper sheets were similar to those produced in the above examples (49–58) and exhibited the same quality and grade evident in the other paper sheets fabricated in those examples.

Water-dispersibility studies for the fibrils produced in some of the following examples were undertaken and results thereof are set forth hereinbelow in Table XII. The dispersibility studies of the fibrils in water were carried out in the same manner and fashion as was done in Examples 38–48 above.

EXAMPLE 62

In this example, fibrils and paper sheets fabricated therefrom were prepared by the process set forth in Example 1. The apparatus employed and the process used in this example were identical to that used in Example 1 with the exception that an additive polymer, an alkylated vinyl-pyrrolidone/α-olefin copolymer, was used and added in a minor amount to the starting hot polyethylene/hydrocarbon solvent solution.

The vessel used in Example 1 was charged with 3.0 liters of Speedsol (the solvent used in Example 1) containing 0.018 gram of the anti-oxidant mixture of Example 1 which was than heated to 150° C. When the solvent/anti-oxidant mixture had attained this temperature, 1.5 grams of GANEX V-216 (an alkylated vinyl-pyrrolidone/α-olefin copolymer obtained from GAF Corporation having an average molecular weight of 7,300 and a density of approximately 0.90 gm./c.c. at 23° C.) was added and dissolved. To the resulting Speedsol/alkylated vinyl-pyrrolidone copolymer solution was added 15.0 grams of a linear high molecular weight polyethylene having an inherent viscosity of 13.33. This mixture was then held with stirring at the 150° C. temperature for a time sufficient to completely dissolve the polyethylene, thereby resulting in a solution suitable for the formation of fibrils by the method set forth in Example 1, and containing about 10 weight % of the alkylated vinyl-pyrrolidone/α-olefin copolymer additive based on the weight of the linear polyethylene. Water-dispersibility studies, were carried out on the fibrils produced by the method set forth above, and these fibrils were used to make paper sheets on the Noble and Wood sheet-forming machine as was done in Example 1. Some of the physical properties of the resultant sheets fabricated in this example were obtained and are recorded in Table XI below, and the data collected in the water-dispersibility studies are reported in the following Table XII.

EXAMPLE 63

In this example, fibrils were prepared and refined by the methods and procedures carried out in Examples 1 and 62 and paper sheets were prepared therefrom in the manner identical to that employed in Examples 1 and 62 with two exceptions. In this example, the additive or modifying polymer employed was used at a higher level or concentration and the Speedsol solvent used in Examples 1 and 62 was replaced with xylene in this example as the solvent for the beginning or starting solution. When employing xylene as the solvent in this and other of the following examples, the heating of the solvent/anti-oxidant mixture and the dissolving of the additive polymer and the linear high molecular weight polyethylene are carried out at a temperature of 135° C. The additive or modifying GANEX V-216 of Example 62 was employed in this example in an amount of 3.0 grams in 3.0 liters of the xylene solvent. The resultant xylene/alkylated vinyl-pyrrolidone copolymer/linear high molecular weight polyethylene solution contained approximately 20 weight % of the alkylated vinyl-pyrrolidone/α-olefin copolymer additive based on the weight of the linear polyethylene. Fibrils were then produced by the method set forth in Examples 1 and 62, water-dispersibility studies were carried out as described above and paper sheets were prepared from the fibrils as was done in Examples 1 and 62. The physical properties of the resultant sheets fabricated on the Noble and Wood sheet-forming machine were determined and are recorded hereinbelow in Table XI, and the data collected in the water-dispersibility studies are reported in the following Table XII.

EXAMPLE 64

In this example, fibrils were prepared and refined in a manner identical to that carried out in Examples 1 and 62 and paper sheets were prepared therefrom in a manner identical to that employed in Examples 1 and 62 with a single exception. In this example, the additive or modifying polymer employed was a different alkylated vinyl-pyrrolidone copolymer which was used at the same level or concentration as that used in Example 62. The alkylated vinyl-pyrrolidone copolymer employed was GANEX V-220 (an alkylated vinyl-pyrrolidone/α-olefin copolymer obtained from GAF Corporation having an average molecular weight of 8,600, a density of approximately 0.95 gm./c.c. at 23° C. and a melting range of approximately 32°-36° C.) and was used in an amount of 1.5 grams. The resultant Speedsol solvent/alkylated vinyl-pyrrolidone copolymer/linear high molecular weight polyethylene solution contained approximately 10 weight % of the alkylated vinyl-pyrrolidone/α-olefin copolymer additive based on the weight of the linear polyethylene. Fibrils were then produced from this solution by the method set forth in Examples 1 and 62, water-dispersibility studies were carried out as described above and paper sheets were prepared from the fibrils as was done in Examples 1 and 62. Some of the physical properties of the resultant sheets fabricated in this example were obtained and are recorded in Table XI below, and the results of the water-dispersibility studies were recorded and are set forth hereinbelow in Table XII.

EXAMPLE 65

In this example, fibrils were prepared and refined by the methods and procedures carried out in Example 64 and paper sheets were prepared therefrom in the same fashion as that used in Example 64 with the single exception that the alkylated vinyl-pyrrolidone/α-olefin copolymer was employed at a higher level or concentration. The alkylated vinyl-pyrrolidone additive was used in an amount of 3.0 grams whereby the resultant solvent/alkylated vinyl-pyrrolidone copolymer/linear high molecular weight polyethylene solution contained approximately 20 weight % of the alkylated vinyl-pyrrolidone/α-olefin copolymer additive based on the weight of the linear polyethylene. Fibrils were produced from this solution by the procedures set forth in Examples 1 and 62, water-dispersibility studies were carried out on the resultant fibrils as described above and paper sheets were prepared from the fibrils produced as was done in Examples 1 and 62. The physical properties of the resultant sheets fabricated on the Noble and Wood sheet-forming machine were determined and are recorded in Table XI below, and the results of the water-dispersibility studies are recorded in Table XII set forth hereinbelow.

EXAMPLE 66

In this example, fibrils were prepared and refined by the methods and procedures carried out in Example 62 and paper sheets were prepared therefrom in a manner identical to that employed in Example 62 with one exception. The exception is that the additive or modifying polymer was a different alkylated vinyl-pyrrolidone/α-olefin copolymer, which was employed at a lower level or concentration than that used in Example 62. The alkylated vinyl-pyrrolidone copolymer employed was GANEX V-516 (an alkylated vinyl-pyrrolidone/α-olefin copolymer obtained from GAF Corporation having an average molecular weight of 9,500, a density of approximately 0.98 gm./c.c. at 23° C. and a melting range of approximately 83°–90° C.) which was used in an amount of 0.75 grams. The resultant solvent/alkylated vinyl-pyrrolidone copolymer/linear high molecular weight polyethylene solution contained about 5 weight % of the alkylated vinyl-pyrrolidone/α-olefin copolymer additive based on the weight of the linear polyethylene. Fibrils were thereafter produced from this solution by the process set forth in Examples 1 and 62, water-dispersibility studies were carried out on the resultant fibrils as described above, and paper sheets were prepared from the fibrils produced as was done in Examples 1 and 62. The physical properties of the resultant sheets fabricated on the Noble and Wood sheet-forming machine were determined and are recorded hereinbelow in Table XI, and the results of the water-dispersibility studies are set forth hereinbelow in Table XII.

EXAMPLE 67

In this example, fibrils were prepared and refined in a manner identical to that employed in Example 66 with the exception that the modifying polymer was employed at a higher level or concentration. The alkylated vinyl-pyrrolidone copolymer of Example 66 was used in an amount of 1.5 grams and the dissolving was carried out at 150° C. in the Speedsol solvent. The resultant solvent/alkylated vinyl-pyrrolidone copolymer/linear high molecular weight polyethylene solution contained approximately 10 weight % of the alkylated vinyl-pyrrolidone/α-olefin copolymer additive based on the weight of the linear polyethylene. Fibrils were then produced by the method set forth in Examples 1 and 62, water-dispersibility studies were carried out on the resultant fibrils as described above and paper sheets were fabricated from the fibrils produced as was done in Examples 1 and 62. Some of the physical properties of the resultant sheets produced in this example were obtained and are recorded in Table XI below, and the results recorded in the waterdispersibility studies are reported in Table XII which follows.

EXAMPLE 68

Fibrils were prepared and refined by the methods and procedures carried out in Example 67 and paper sheets were prepared therefrom in a manner identical to that employed in Example 67 with the single exception that the additive or modifying polymer employed was used at yet a higher level or concentration. The alkylated vinylpyrrolidone copolymer used was the GANEX V-516 of Examples 66 and 67 and was employed in an amount of 3.0 grams, whereby the resultant solvent-/alkylated vinyl-pyrrolidone copolymer/linear high molecular weight polyethylene solution contained about 20 weight % of the alkylated vinyl-pyrrolidone/α-olefin copolymer additive based on the weight of the linear polyethylene. Fibrils were then produced from this solution by the processes set forth in Examples 1 and 62, water-dispersibility studies were undertaken and carried out on the fibrils as described above and paper sheets were fabricated from the resultant fibrils as was done in Example 1 and 62. The physical properties of the paper sheets fabricated on the Noble and Wood sheet-forming machine were determined and are reported in the following Table XI, and data collected in the water-dispersibility studies were recorded and are set forth hereinbelow in Table XII.

EXAMPLE 69

The above Example 63 was repeated using 0.75 gram of another alkylated vinyl-pyrrolidone copolymer, whereby the resultant xylene/alkylated vinyl-pyrrolidone copolymer/linear high molecular weight polyethylene solution contained approximately 5 weight % of the alkylated vinyl-pyrrolidone/α-olefin copolymer additive based on the weight of the linear polyethylene. The alkylated vinyl-pyrrolidone copolymer employed was GANEX V-804 (an alkylated vinyl-pyrrolidone/α-olefin copolymer obtained from GAF Corporation having an average molecular weight of 19,000, a density of approximately 1.09 gm./c.c. at 23° C. and a melting range of from about 131°–140° C.) The physical properties of the paper sheets fabricated on the Noble and Wood sheet-forming machine were determined and are reported in the following Table XI, and the data collected in the water-dispersibility studies were recorded and are set forth hereinbelow in Table XII.

EXAMPLE 70

In this example, fibrils were prepared and refined in a fashion similar to that employed in Example 69 with the exception that the alkylated vinyl-pyrrolidone copolymer of Example 69 (GANEX V-804) was used and employed at a higher level or concentration. The alkylated vinyl-pyrrolidone/α-olefin copolymer used was employed in the amount of 3.0 grams. The resulting solvent/alkylated vinyl-pyrrolidone copolymer/linear high molecular weight polyethylene solution contained approximately 20 weight % of the alkylated vinyl-pyrrolidone/α-olefin copolymer additive based on the weight of the linear polyethylene. Fibrils were thereafter produced by the method set forth in Examples 1 and 62, water-dispersibility studies of the fibrils were undertaken as described above, and paper sheets were fabricated from the resultant fibrils as was done in Examples 1 and 62. The physical properties of the resultant sheets prepared on the Noble and Wood sheet-forming machine were determined and are set forth hereinbelow in Table XI and the results of the water-dispersibility studies are recorded in the following Table XII.

EXAMPLE 71

In this example, fibrils were prepared and refined in a fashion similar to that employed in Example 62 with the exception that tetralin was substituted for the Speedsol solvent, and with the further exception that a different alkylated vinyl-pyrrolidone copolymer was used and was employed at the same level or concentration as that of Example 62. The alkylated vinyl-pyrrolidone/α-olefin copolymer used was Ganex V-816 (an alkylated vinyl-pyrrolidone/α-olefin copolymer obtained from GAF Corporation having an average molecular weight of 20,000, a density of approximately 1.03 gm./c.c. at 23° C. and a melting range of about 146°–152° C.) which was employed in the amount of 1.5 grams. The dissolving of the linear high molecular weight polyethylene in the tetralin solvent was carried out at 160° C. The resulting solvent/alkylated vinyl-pyrrolidone copolymer/linear high molecular weight polyethylene solution contained approximately 10 weight % of the alkylated vinyl-pyrrolidone/α-olefin copolymer additive based on the weight of the linear polyethylene.

Fibrils were thereafter prepared by the method set forth in Examples 1 and 62, water-dispersibility studies of the fibrils were undertaken as described above and paper sheets were fabricated from the resultant fibrils as was done in Examples 1 and 62. The physical properties of the resultant sheets prepared on the Noble and Wood sheet-forming machine were determined and are set forth hereinbelow in Table XI and the results of the water-dispersibility studies are recorded in the following Table XII.

EXAMPLE 72

Example 71 above was repeated using 3.0 grams of another alkylated vinyl-pyrrolidone copolymer, whereby the resulting tetralin/alkylated vinyl-pyrrolidone copolymer/linear high molecular weight polyethylene solution contained about 20 weight % of the alkylated vinyl-pyrrolidone/α-olefin copolymer additive based on the weight of the linear polyethylene. The alkylated vinyl-pyrrolidone copolymer used was GANEX V-904 (an alkylated vinyl-pyrrolidone/α-olefin copolymer obtained from GAF Corporation having an average molecular weight of 16,000, a density approximately 1.09 gm./c.c. at 23° C. and a melting range of about 188°–195° C.). The physical properties of the resultant sheets prepared on the Noble and Wood sheet-forming machine were determined and are set forth hereinbelow in Table XI, and the data collected in the water-dispersibility studies are reported in Table XII which follows.

EXAMPLE 73

In this example, the fibrils of this invention are produced by the process illustrated in FIGS. 4–6, using a size 12, Mark III centrifuge, manufactured by the Fletcher Division of Sharples Corporation, as the centrifugal spinning device, and then these fibrils were used to fabricate a paper sheet.

The dissolver vessel was charged with 500 ml. of the substantially aliphatic hydrocarbon solvent Speedsol (boiling range 155°–180° C.), 2.5 g. of a linear high molecular weight polyethylene containing 500 p.p.m. of a mixture of equal parts by weight of Ionol, Santonox R (trademarks) and dilauryl thiodipropionate as antioxidant stabilizers for the polyethylene. The ethylene polymer used had an inherent viscosity of 13.33 measured at a concentration of 0.05 g./100 ml. of decalin at 135° C. The mixture was heated to 145° C. and held at that temperature with stirring for a period of approximately 4 hours to dissolve the polethylene, resulting in a solution having a viscosity of 190 centipoises (at 145° C.) and containing about 0.65 weight percent polyethylene. This solution was then introduced into the centrifuge which was rotating at approximately 10,000 rpm. The centrifuge used in this example had a diameter of 12 inches and the horizontal distance that the polymer solution traveled between its point of entry and the wall of the rotating basket was about 3½ inches. The polymer solution precipitated in the form of a solvent swollen fibrous rope on the walls of the outer basket of the centrifuge and was retained thereon while the majority of the solvent passed through the foraminous basket and was collected at the liquids outlet or dis- Table XI

| Property* | Ex. 62 | Ex. 63 | Ex. 64 | Ex. 65 | Ex. 66 | Ex. 67 | Ex. 68 | Ex. 69 | Ex. 70 | Ex. 71 | Ex. 72 |
|---|---|---|---|---|---|---|---|---|---|---|---|
| Basis Weight, lbs./3000 ft.² | 57.77 | 51.69 | 57.74 | 54.28 | 56.39 | 56.91 | 47.10 | 55.33 | 51.36 | 53.20 | 52.90 |
| Tensile Strength, pli | 13.92 | 7.73 | 16.02 | 14.60 | 15.48 | 13.67 | 4.88 | 11.73 | 7.36 | 10.51 | 10.09 |
| Tensile Factor | 0.24 | 0.15 | 0.28 | 0.27 | 0.27 | 0.24 | 0.10 | 0.21 | 0.14 | 0.20 | 0.19 |
| Stretch, % | 41.31 | 10.72 | 55.27 | 51.92 | 55.66 | 52.61 | 6.15 | 21.70 | 6.03 | 19.45 | 19.08 |
| Mullen Burst Strength, psi | 38.3 | 23.8 | 43.3 | 39.9 | 39.5 | 36.2 | 12.1 | 30.8 | 17.4 | 30.3 | 29.0 |
| Mullen Burst Factor | 0.66 | 0.45 | 0.73 | 0.71 | 0.70 | 0.64 | 0.28 | 0.57 | 0.36 | 0.57 | 0.54 |
| Elmendorf Tear, g./sheet | 226.7 | 184.7 | 210.0 | 172.0 | 210.0 | 210.7 | 106.0 | 202.7 | 176.7 | 248.7 | 246.7 |
| Elmendorf Tear Factor | 3.93 | 3.58 | 3.68 | 3.20 | 3.72 | 3.70 | 2.23 | 3.62 | 3.38 | 4.67 | 4.67 |
| Fold Endurance, cycles to break | >10,000 | >10,000 | >10,000 | >10,000 | >10,000 | >10,000 | 9.0 | >10,000 | >10,000 | >1,000 | >10,000 |
| Opacity, % | 76.8 | 74.6 | 74.1 | 72.2 | 74.6 | 75.1 | 93.7 | 79.2 | 75.8 | 79.1 | 83.0 |
| Brightness, % | 67.0 | 65.2 | 63.4 | 59.0 | 64.2 | 61.0 | 81.1 | 69.0 | 67.3 | 69.8 | 72.1 |

*Tappi Procedure No. T220 M-60

Table XII

| Ex. | % dry Fibrils on Water Surface | Volume (ml) of Wet Fibrils After 30 sec. | 60 sec. | 10 min. | Time (sec) Required for Volume of Wet Fibrils to Decrease to 100 ml. | 80 ml. |
|---|---|---|---|---|---|---|
| 62 | trace | 95 | 90 | 75 | 20 | 120 |
| 63 | none | 110 | 100 | 85 | 60 | >900 |
| 64 | none | 100 | 95 | 70 | 12 | 30 |
| 65 | none | 105 | 100 | 90 | 60 | >900 |
| 66 | none | 90 | 85 | 75 | 15 | 120 |
| 67 | none | 100 | 98 | 90 | 30 | >900 |
| 68 | none | 200 | 170 | 125 | >900 | — |
| 69 | 10 | 45 | 40 | 40 | 1 | 2 |
| 70 | trace | 80 | 75 | 70 | 7 | 9 |
| 71 | none | 110 | 105 | 90 | 110 | >900 |
| 72 | 5 | 55 | 50 | 50 | 1 | 2 |

charge port of the apparatus. The resultant fibrous rope was removed from the spinning device and put through a wringer, as at 232, wherein it was pressed free of excess Speedsol solvent and then directed to a chopper where it was cut into 1 inch lengths. The cut or chopped fibrous rope was then directed to a refiner or beater, as at 40, for further treatment and refining. The beater or refiner used in this example was a Waring blender. The chopped fibrous rope was beaten in the blender to which isopropanol was supplied until a uniform suspension of fibrils was obtained. The suspension was filtered, reslurried and suspended in fresh isopropanol and further beaten in the blender. This operation was then again repeated. The filtrate containing residual Speedsol solvent could be reclaimed from the ground and refined fibrils. The resultant fibril product was a pulp containing a low level of hydrocarbon which was suitable for and was used to make paper hand sheets on a Noble and Wood sheet-forming machine. To obtain the paper hand sheets, the fibril product or pulp obtained by the process of this invention was slurried to the head box of the Noble and Wood machine and a sheet was formed thereon by the usual and normal methods employed in the use of this sheet-forming machine. The paper sheet produced had the appearance of a conventionally produced paper, was strong and tough and possessed good paper qualities.

EXAMPLE 74

In this example, fibrils were prepared and refined by the methods and procedures carried out in Example 73, and a paper sheet was prepared therefrom in the manner identical to that employed in Example 72 with one exception. The exception is that in this example isotactic polypropylene was employed instead of the linear polyethylene. The isotactic polypropylene was used in an amount of 3.0 g. in the 500 ml. of the Speedsol solvent resulting in a solution containing 0.85 weight % polymer. The polypropylene had an inherent viscosity of 8.7 measured at a concentration of 0.5 g./100 ml. of decalin at 135° C. and a molecular weight of approximately 1,330,000. Excellent fibrils were obtained and the sheet prepared on the Noble and Wood machine possessed good paper qualities and had the appearance of a conventionally produced paper.

EXAMPLE 75

In this example, uniform fibrils suitable for paper making were prepared and refined as described in Example 73 with the exception that the centrifuge was rotated at approximately 900 rpm and a different polyethylene was used. The hot solution in this example included 5.0 g. of a linear polyethylene having a high load melt index as determined by ASTM Test No. D1238-65T, Condition F, of 0.066 dissolved in 1,000 ml. of the hydrocarbon solvent tetralin as well as the anti-oxidant stabilizers used in Example 72 to result in a solution containing 0.65 weight % polyethylene.

EXAMPLE 76

In this example, dissolver 210 was a 200 gal. reactor to which 100 gal. of the hydrocarbon solvent Speedsol was added and heated. When the temperature of the solvent reached 125° C., 4.5 lbs. of the linear polyethylene used in Example 73 was added. The temperature was then raised to 145° C. After the polyethylene had completely dissolved, 1 gal. portions of the hot solution (containing 0.7 weight % polymer and having a viscosity of 230 centipoises at 145° C.) were drawn off and charged batch-wise into the centrifuge which was rotating at 1,000 rpm during the addition and was thereafter increased to 2,400 rpm after the addition was complete in order to more efficiently separate a substantial portion of the solvent from the fibrous rope after the same had formed. When the liquids discharge from the centrifuge became nil, the basket rotation was stopped and the fibrous rope was removed. This procedure was then again repeated until the entire 100 gal. of hot polymer solution had been used. The resulting fibrous ropes were then cut into strips several inches in length and charged to a refining apparatus, as at 240, which in this example consisted of a garbage disposal which was continuously fed with isopropanol. The product in the form of small fibril wads or masses and the isopropanol was collected from the exit port of the disposal and separated on a coarse mesh screen. Thereafter, the fibril masses were further refined and washed in a Waring blender as described in Example 73. The resultant fibrils were of uniform texture and good quality suitable for making into paper.

EXAMPLE 77

In this example, fibrils were prepared and refined by the methods and procedures set forth in Example 76 with the exception that the linear polyethylene used had an inherent viscosity of 3.52 and was used in an amount of 3.5 lbs. in 265 lbs. of Speedsol solvent to give a solution containing 1.3 weight % polymer. The fibrils obtained were of good quality and suitable for making into paper sheets.

EXAMPLE 78

In this example, the procedure of the previous example was repeated using 5.0 lbs. of the same linear polyethylene dissolved in 265 lbs. of Speedsol solvent such that the resultant solution had a polymer concentration of 1.85 weight % and a viscosity of 60 centipoises at 145° C. The resulting fibrils obtained after refining were of equally good quality.

EXAMPLE 79

In this example, uniform fibrils of good quality and suitable for paper making were prepared by the use of a centrifugal spinning device similar to that shown in FIGS. 5 and 6 of the drawings. The device used in this example had a inner drum or basket with a perforated side wall and was of a cylindrical shape instead of the conical shape as shown at reference numeral 288 in the drawings. The outer cylindrical basket did not have a perforated side wall nor was it rotated, but was jacketed and cooled by continuously feeding a coolant liquid through the jacketing about the basket. The distance between the side wall of the inner drum and the side wall of the outer basket was about 12 inches.

30 g. of a linear polyethylene having an inherent viscosity of 3.52 and containing 500 parts per million of the antioxidant stabilizer system set forth in Example 73 was dissolved in 1,500 ml. of the substantially aliphatic hydrogen solvent Speedsol at 145° C. This resulted in a polymer soluton having a viscosity of 270 centipoises (at 145° C.) and containing approximately 2.5 weight % solids. The solution was then fed into the inner cylindrical basket of the centrifugal spinning device which was rotating at approximately 3,000 rpm and which had been preheated to a temperature corresponding to the temperature of the hot polymer solution (approximately 145° C.). The hot polymer solution was forced through the holes or perforations in the side wall of the cylindrical inner drum by centrifugal force and flung outward to be deposited on the cold walls of the outer cylindrical basket in the form of a solvent swollen fibrous mass. This mass was then removed from the device and converted and refined into fibrils by the method set forth in Example 73. The resulting fibrils obtained after refining were of uniform texture and good quality suitable for making into paper.

EXAMPLE 80

In this example, fibrils were produced by the improved process of this invention illustrated in FIG. 7 using as the die (reference numeral 422) a dip tube having a circular cross section with a diameter of approximate ¼ inch and a length of approximately 25 inches. The dissolver 410 employed in this example was an autoclave and the hot polymer solution was forced or expressed therefrom and through die 422 by means of argon pressure, in lieu of a pump, as at reference numeral 418.

The autoclave (dissolver 410) was charged with 1350 grams of the substantially aliphatic hydrocarbon solvent Speedsol (boiling range 155°–180° C.) and 60.0 grams of a linear high molecular weight polyethylene having an inherent viscosity of 13.33 measured at a concentration of 0.05 gram per 100 milliliters of decalin at 135° C. The polymer was dissolved in the solvent at a temperature of 135° C. resulting in a solution containing about 4.25 weight % polyethylene and having a viscosity of about 700 kilopoises (at 145° C.). This solution was then forced from the autoclave by 120 psig argon pressure and through the above-described dip tube (die 422). This viscous solution emerged from the other end of the dip tube in the form of a molten strand which was then drawn through a quenching or cooling bath (as at reference numeral 424) containing isopropanol wherein solidification occurred to result in a solvent swollen fibrous strand. The strand was maintained under tension as it was drawn through the cooling bath and the resultant solvent swollen strand was wound on a take-up roll following emergence from the cooling bath. The strand was next manually cut into ½ inch lengths and then the cut or chopped fibrous bundles were directed to a refiner or beater, as at reference numeral 448, for further treatment and refining. The beater or refiner used in this example was a Waring blender. The chopped fibrous strand swollen with solvent was beaten in the blender to which isopropanol was supplied until a uniform suspension of the fibrils was obtained. The suspension was filtered, reslurried and suspended in fresh isopropanol and further beaten in the blender. This operation was then again repeated. The filtrate containing residual Speedsol solvent could be reclaimed from the ground and refined fibrils. The resulant fibril product was a pulp containing a low level of hydrocarbon which was suitable for and was used to make paper hand sheets on a Noble and Wood sheet-forming machine. To obtain the paper hand sheets, the fibrils product or pulp obtained by the process of this invention was slurried to the head box of the Noble and Wood machine and a sheet was formed thereon by the usual and normal methods employed in the use of this sheet-forming machine. The paper sheet produced had the appearance of a conventionally produced paper, was strong and tough, and possessed good paper qualities.

EXAMPLES 81–84

In these examples, fine uniform fibrils suitable for paper making were prepared and refined as described above in Example 80 but at a number or variety of production rates or take-up speeds.

A 1 gallon autoclave was charged with 1750 milliliters of the hydrocaron solvent Speedsol and 60 grams of a linear high molecular weight polyethylene having an inherent viscosity of 13.33 measured at a concentration of 0.05 gram per 100 milliliters of decalin at 135° C. After the autoclave was flushed free of air with argon, the mixture was heated with stirring to a temperature of 133° C. to dissolve the polyethylene. The resulting solution containing 4.25 weight % solids was forced through the ¼ inch dip tube as described in Example 80 by the use of 120 psig argon pressure. The viscous polymer solution emerged from the drip tube in the form of a molten strand and was maintained under tension while it was drawn through a cooling bath containing isopropanol and maintained at a temperature of −25° C. wherein the polymer in the strand precipitated. The strand exited the cold quenching bath in the form of a solvent swollen fibrous strand and was wound on a take-up roll. During four individual time periods, the take-up roll was run at four different speeds to produce four different solvent swollen fibrous strands. A sample from each of the four different strands was converted into fine uniform fibrils suitable for making into paper by refining each of the strands in isopropanol in a Waring blender. The take-up speed and corresponding weight of the fibrous strand in each of the four runs is set forth below in Table XIII.

Table XIII

| Example | Take-up Speed (ft./min.) | Weight of Dried Strand (g./ft.) |
|---|---|---|
| 81 | 15 | 0.0448 |
| 82 | 31 | 0.0263 |
| 83 | 35 | 0.0174 |
| 84 | 63 | 0.0088 |

EXAMPLE 85

In this example, filled fibers were prepared from a polyethylene solution wherein the filler employed was silica ($SiO_2$) and was present in an amount of approximately 50 weight % of the total solids incorporated into the solution from which the fibrils were formed. To form the fibrils, a solution was first prepared from approximately 1500 ml. of the hydrocarbon solvent Apco 140 (boiling range 180°–200° C.) in which 7.5 g. of a linear high molecular weight ethylene polymer was dissolved at a temperature of about 150° C. The ethylene polymer used had a high load melt index so low, as determined by ASTM Test No. D1238-65T, Condition F, that the same was not measurable. To this solution was added 7.5 g. (50 weight % of the total solids added to the solvent) of pyrogenic silica (flattening agent, Aerosil ST, obtained from Degussa). The silica was suspended in the solution by constant stirring and agitation of the same. Polyethylene fibrils suitable for paper production then were prepared by the techniques illustrated in FIGS. 1–3 and described in Example 1. The resultant fibers were of good quality for paper production, having a length of about 1 up to about 5 mm. and a diameter in the range of from about 10 up to about 30 microns.

A paper sheet was prepared using the thus obtained polyethylene fibrils by adding 2 g. of the same to 500 ml. of water containing 10 drops of a surfactant, such as Triton 100. The resulting slurry then was charged to the head box of a Noble and Wood sheet-forming machine and thereafter diluted with about 5 volumes of water (approximately 2500 ml.) for the sheet-forming operation. The paper sheet was then formed by the usual and normal methods employed in the use of this Noble and Wood sheet-forming machine and thereafter dried. The resulting sheet was determined to be of good paper quality and was determined to contain 30 weight % silica.

EXAMPLE 86

In this example, filled polyethylene fibrils and a paper sheet therefrom, similar to the fibrils and sheet obtained in Example 85, were formed by the processes set forth in that example. However, in this example the filler employed was calcium carbonate ($CaCO_3$, Fisher CP, obtained from Fisher Scientific Company) and was employed at the level of 20 weight % of the total solids added to the solvent from which the fibrils were produced. In this particular case, 30 g. of a linear high molecular weight polyethylene having a high load melt index as determined by ASTM Test No. D-1238-65T, Condition F, of 0.24 g./10 min. was added to and dissolved at approximately 150° C. in 1500 ml. of the hydrocarbon solvent Speedsol (boiling range 155°–180° C.). To this solution was added and suspended 7.5 g. of the above-identified calcium carbonate. Polyethylene fibrils suitable for paper production were prepared from this solution as was done in Example 85. A sheet was prepared from the resultant fibrils as in Example 85 and was found to possess good paper qualities and contain 18.6 weight % calcium carbonate. This high weight percent figure indicates that well over 90 % of the original calcium carbonate added to the solvent solution was retained in the polyethylene fibrils produced and the paper formed therefrom.

EXAMPLE 87

Fibrils and a paper sheet thereof were formed by the methods of Example 85, using as a filler titanium dioxide ($TiO_2$, Zopaque, obtained from the Glidden Company) in an amount of 20 weight % of the total solids added to the solvent solution. The solvent and polymer used in this example were the same solvent and polymer used in Example 86 and employed in the same amounts as set forth in that example. To the resulting solution of solvent and polymer was added 7.5 g. of the hereinbefore identified titanium dioxide which was suspended in the solution by stirring and agitaton. Polyethylene fibrils of good quality for use in the paper-producing process then were prepared from this solution by the method described in Example 85. A sheet was formed from the resultant fibrils in accordance with the process of Example 85 on the Noble and Wood sheet-forming machine. The resultant sheet had good paper qualities and the amount of titanium dioxide found therein was determined to be 19.96 weight %, indicating that nearly all of the titanium dioxide added to the Speedsol solution was retained through the fibril preparation and paper production steps.

EXAMPLE 88

Filled polyethylene fibrils and a paper sheet from those fibrils were prepared, by the methods and processes as set forth in Example 85, employing the solvent and linear high molecular weight ethylene polymer of Example 86 in like amounts. These fibrils contained as the filler kaolin clay (Ultra-White 90, obtained from Engelhard Minerals & Chemical Corporation) which was employed in an amount of 9 weight % of the total solids added to the Speedsol solvent. After dissolving the 30 g. of polyethylene in the 1500 ml. of Speedsol at 150° C., 3 g. of the above-identified kaolin clay was added thereto and suspended therein. Filled polyethylene fibrils were spun from this solution as in the previous examples, and a sheet was formed therefrom on the Noble and Wood sheet-forming machine as described in Example 85. The resultant sheet was found to possess good paper qualities and the clay content thereof was determined to be about 6.2 weight %.

EXAMPLE 89

In this example, filled polyethylene fibrils and a paper sheet thereof, similar to those obtained in Example 85, were formed by the methods and procedures of Example 85. However, in this example the filler employed was calcium carbonate ($CaCO_3$, Fisher CP, obtained from Fisher Scientific Company) and was used at the level of 33 weight % of the total solids added to the solvent solution. The polymer and solvent used to prepare the polyethylene fibrils were identical to those used in Example 86 and were employed in the same amounts. After the polyethylene had been dissolved in the Speedsol at approximately 150° C., 15 g. of the previously identified calcium carbonate which had been prewet with 30 ml. of mineral oil was added to the solution and suspended therein by stirring and agitation. Polyethylene fibers suitable for paper production and of good quality were spun from this solution as was done in the previous examples. A sheet was formed from the resultant filled polyethylene fibers on the Noble and Wood sheet-forming machine by the procedure of Example 85 and thereafter dried. The resultant sheet was of good paper quality and it was determined that the same contained 28 weight % of the previously suspended hydrocarbon insolvent filler material (in this example calcium carbonate).

EXAMPLE 90

Filled polyethylene fibers and a paper sheet thereof were formed by the methods of Example 85 employing another kaolin clay (Min Chem Special Pulverized, obtained from Engelhard Minerals & Chemicals Corporation) and employed in an amount of 50 weight % of the total solids added to the solvent. The beginning solution consisted of 30 g. of the linear high molecular weight polyethylene employed in Example 86 dissolved at approximately 150° C. in 1500 ml. of Speedsol solvent (see Example 86) to which was added 30 g. of the kaolin clay identified in this example, which had been previously prewet with 50 ml. of mineral oil. The kaolin clay was suspended in the solution by stirring and agitation and filled polyethylene fibers suitable for use in the paper-making process were produced therefrom by a solution spinning process as in the previous examples. Following this, a paper sheet was prepared from the resultant fibrils as in Example 85 on the Noble and Wood sheet-forming machine and dried. The final sheet after drying was found to possess good paper qualities and it was determined that the kaolin clay was present therein an an amount of 44 weight %.

EXAMPLE 91

In this example, polyethylene fibrils containing kaolin clay (Min Chem Special Predispersed, obtained from Engelhard Minerals & Chemicals Corporation) as a filler were produced and were then used in the preparation of a paper sheet by the methods and processes as set forth in Example 85. The kaolin clay employed was used at a level of 50 weight % of the total solids added to the solvent, and the solvent and linear high molecular weight ethylene polymer employed were those set forth in Example 86 and were used in the same amounts. 30 g. of this particular kaolin clay, after having been prewet with 50 ml. of mineral oil, was dispersed and suspended in the solution from which the filled polyethylene fibrils were then produced by solution spinning as in the previous examples. The fibrils produced were of good quality and readily employable in the paper-making process. A paper sheet was then prepared on the Noble and Wood sheet-forming machine by the procedure of Example 85 from these filled polyethylene fibrils. The resultant sheet after drying was observed to possess good paper qualities and the kaolin clay content thereof was determined to be 39 weight %.

EXAMPLE 92

The fibrils and paper sheet formed in this example were similar to those obtained in Example 91, with the exception that the resultant sheet contained approximately 48 weight % of another kaolin clay. To produce the sheet of this example, a starting solution consisting of 1500 ml. of Speedsol in which 30 g. of the linear high molecular weight ethylene polymer used in Example 86 had been dissolved at 150° C. and 30 g. of a kaolin clay (Klondyke Predispersed, obtained form Engelhard Minerals & Chemicals Corporation) prewet with 50 ml. of mineral oil had been predispersed, was employed. Filled fibrils and a dried paper sheet thereof were produced as in Example 85. The resultant sheet contained 40 weight % of the kaolin clay and was observed to have good paper qualities. This amount of clay in the resultant sheet indicated that well over 95 % of the original clay added to the solvent solution was retained in the formed fibrils and the paper sheet fabricated therefrom

EXAMPLE 93

Filled fibrils and a paper sheet thereof were formed respectively by the solution spinning and the Noble and Wood sheet-forming machine methods of Example 85, which included as a filler calcium carbonate ($CaCO_3$, Atomite, obtained from Thompson, Weinman & Company), employed at a level of 20 weight % of the total solids added to the Speedsol solvent. The starting solution consisted of 2000 ml. of Speedsol solvent at approximately 150° C., into which was placed 10 g. of the linear high molecular weight ethylene polymer employed in Example 1 and simultaneously 2.5 g. of the above-identified calcium carbonate. After the polymer had been dissolved, fibrils of good quality and suitable for use in the paper-making process were solution spun therefrom while the calcium carbonate was suspended therein by proper agitation of the solution, the fibrils being obtained as in the previous examples. A paper sheet was produced from these filled polyethylene fibrils as in Example 85 and then dried. The resultant sheet was determined to possess good paper qualities and the calcium carbonate content thereof was found to be 12.3 weight %.

In order to compare the physical properties of a paper sheet fabricated from filled fibrils to a paper sheet produced from unfilled fibrils, two additional experiments were conducted, the results of which are set forth in the following two examples. In the first of these examples, the resultant paper sheet contained 29 % kaolin clay (Klondyke Predispersed, obtained from Engelhard Minerals & Chemicals Corporation), and in the second example the fibrils and paper sheet were unfilled.

EXAMPLE 94

Filled polyethylene fibrils were formed in this example by the method and process set forth in Example 85, with the exception that the filler used was a kaolin clay (Klondyke Predispersed, obtained from Engelhard Minerals & Chemicals Corporation), which was employed at a level of 40 weight % of the total solids added to the solvent. The starting solution consisted of 3000 ml. of Speedsol solvent at a temperature of approximately 150° C. into which was dispersed 15 g. of the linear high molecular weight ethylene polymer used in Example 85 and simultaneously therewith 9.9 g. of the previously identified kaolin clay. Filled polyethylene fibrils suitable for paper-making were solution spun from this mixture, after dissolving of the polymer in the solvent and suspending of the clay therein, by the procedure employed in Example 85. Next, a paper sheet was formed on the Noble and Wood sheet-forming machine from the produced filled polyethylene fibrils by the procedure set forth in Example 85 and dried. The clay content of the resultant sheet was determined to be 29 weight %.

EXAMPLE 95

In this example, polyethylene fibrils were prepared in a substantially identical manner to the polyethylene fibrils obtained in Example 94, with the single exception that no filler was incorporated into the fibrils. The fibrils obtained were of good quality and suitable for use in the paper-making process. Following the formation of the unfilled polyethylene fibrils from solution, the same were used to produce a paper sheet on the Noble and Wood sheet-forming machine in a manner identical to that of Example 94. The resultant sheet after drying was determined to have good paper qualities.

Certain physical tests were run on each of the paper sheets produced in Examples 94 and 95 for comparison purposes. The results of these tests were recorded and are reported in Table XIV as follows:

Table XIV

| Property* | Example 95 | Example 94 |
|---|---|---|
| Basis Weight, lbs./3000 ft.$^2$ | 43.74 | 41.48 |
| Caliper, thousandths | 8.10 | 7.20 |
| Apparent Density | 0.299 | 0.342 |
| Tensile, pli | 6.03 | 5.39 |
| Tensile Factor | 0.136 | 0.120 |
| Stretch, % | 8.11 | 11.37 |
| Elmendorf Tear, g/sheet | 173.3 | 108.6 |
| Elmendorf Tear Factor | 4.262 | 2.674 |
| Mullen Burst, psi | 18.6 | 15.3 |
| Mullen Burst Factor | 0.439 | 0.337 |
| MIT Fold Endurance | | |
| Basis Weight, lbs./3000 ft.$^2$ | 42.59 | 45.01 |
| Cycles to Break | 315 | 589 |
| Cycles to Break, range | 9–1443 | 9–4004 |

Table XIV-continued

| Property* | Example 95 | Example 94 |
|---|---|---|
| Tension at Break, kg. | 0.76 | 0.79 |

*Tappi Procedure No. T220 M-60

As can be seen from the above and a study and comparison of the results recorded therein, the retention of most of the physical properties from the sheet without the filler (Example 95) to the sheet with the filler (Example 94) is good.

EXAMPLE 96

In this example, paper was made from a 50–50 blend of polyethylene fibers and unbleached Kraft fibers or pulp paper. The polyethylene fibers were prepared by the method of Example 1 from a linear, high molecular weight polymer of ethylene having a high load melt index as determined by ASTM Test No. D1238-65T, Condition F, of 0.24 g./10 min. The paper was prepared by employing these polyethylene fibers and unbleached Kraft pulp in a blend of the fibers containing 1 g. of the polyethylene fibers and 1 g. of the Kraft pulp. This 2 g. mixture of polyethylene and Kraft fibers was added to 50 ml. of water containing 10 drops of a surfactant, such as Triton 100. The resulting slurry was then charged to the head box of a Noble and Wood sheet-forming machine and thereafter diluted with approximately 5 volumes of water (approximately 2500 ml.) for the sheet-forming operation. The sheet was then formed by the usual and normal methods employed in the use of this Noble and Wood sheet-forming machine and thereafter dried.

To test the heat-sealability of the thus formed paper sheet and the resulting strength of the to-be-formed heat-seal, if such is indeed formed, the dried paper sheet was cut in two. Thereafter, the between the pieces were placed one upon the other in overlapping relationship. The two overlapped pieces were then placed in the jaws of a Robot heat-sealer wherein heat-seals were made, or attempted to be made, between the overlapped pieces of the paper sheet. The Robot heat-sealer employed in making the heat-seals had a ⅛ inch bar and only one of its jaws was heated. The heat-sealing was done at a temperature of 325° F. under a pressure of 38 psi and for a time of 1 second. In order to test the heat-seal betweenthe two overlapped pieces of sheet and the strength of the bond therebetween, the two pieces or specimens were subjected to a tensile test, in which they were separated by the use of steady but increasing pressure in opposite directions. The heat-seal or bond between the sheets was observed during and after separation, from which one can obtain some type of quantitative idea of the strength of the seal between the sheets. In this particular case, the heat-seal between the sheets held and the fibers of the sheets in the vicinity of the bond tore when the two sheets were separated, indicating that the bond therebetween was of high strength.

EXAMPLE 97

In this example, a heat-sealable paper sheet, similar to the sheet obtained in Example 96, was formed by the process as set forth in that example. However, in this example the resultant paper sheet contained 33⅓ % by weight of the polyethylene fibers, as the starting fiber mixture consisted of 2 g. of unbleached Kraft pulp or fiber and 1 g. of fibers produced from the ethylene polymer of Example 96. The sheet after being formed on the Noble and Wood sheet-forming machine was heat-sealed and tested as in Example 96 and found to be capable of heat-sealing with a high bond strength requiring tearing of the fibers in the vicinity of the heat-seal in order to separate the sheets from each other.

EXAMPLE 98

A heat-sealable paper sheet was formed by the method of Example 96 on the Noble and Wood sheet-forming machine which had a polyethylene fiber content of 25 % by weight. The blend or mixture of starting fibers consisted of 3 g. of unbleached Kraft pulp or fibers and 1 g. of polyethylene fibers prepared from the polyethylene resin of EXample 96. The resulting paper sheet was capable of being heat-sealed on the Robot heat-sealer employed as in Example 96. When the resulting heat-seals were tested for strength and bonding as in Example 96, fiber tear resulted in the sheets upon separation adjacent the heat-seal indicating that the heat-seal was of high strength.

EXAMPLE 99

A heat-sealable paper sheet was prepared by the method and process as set forth in Example 96. This sheet had a polyethylene fiber content of approximately 5.87 % by weight and the beginning mixture or blend of fibers consisted of 4.0 g. of unbleached Kraft pulp or fibers and 0.25 g. of fibers produced from the ethylene polymer of Example 96. Heat-seals were attempted between two overlapped pieces of the thus formed paper sheet on the Robot heat-sealer as described and by the process set forth in Example 96. It was determined that heat-seals between the overlapped pieces of the paper sheet containing this small amount of polyethylene fibers were not possible, as upon an attempted separation the two pieces separated with no fiber tear, indicating that no bond had been formed therebetween.

EXAMPLE 100

In this example, a heat-sealable paper sheet, similar to that obtained in Example 95, was formed by the method of Example 95. However, in this example the resultant heat-sealable paper sheet contained approximately 16.6 weight % polyethylene fibers; the polyethylene fibers having been prepared from a very high molecular weight linear polymer of ethylene which had a high load melt index so low, as determined by ASTM No. D1238-65T, Condition F, that the same was not measurable. The beginning fiber mixture or starting blend for the sheet consisted of 2.5 g. of unbleached Kraft fiber or pulp and 0.5 g. of polyethylene fibers produced from the aforementioned ethylene polymer of this example. The resulting paper sheet was capable of being heat-sealed on the Robot heat-sealer as mentioned in Example 96 and by the process employed in that example. The resultant heat-seals were tested for bonding strength, and upon separation of the overlapped pieces of the sheet it was observed that fiber tear occurred adjacent the heat-seal, indicating that the bond therebetween was of high strength.

EXAMPLE 101

A heat-sealable paper sheet was formed by the method of Example 96 on the Noble and Wood sheetforming machine which had a polyethylene fiber content of approximately 11.1 weight %. The beginning blend consisted of 2.0 g. of unbleached Kraft pulp and 0.25 g. of polyethylene fibers prepared from the polyethylene resin used in Example 100. The paper sheet obtained was heatsealed on the Robot heat-sealer of Example 96 and by the process employed in that example. The resultant bond formed between the two pieces of the sheet was of high strength, which was indicated by a tearing of the fibers adjacent the heat-seal observed during the pulling apart and subsequent separation of the pieces from each other.

EXAMPLE 102

In this example, polyethylene fibers which contained a filler were used in the preparation of a heat-sealable paper sheet by the method and process as set forth in Example 96. The polyethylene fibers employed contained 10 weight % calcium carbonate and were prepared from the high molecular weight linear ethylene polymer used in Example 100. The starting fiber blend consisted of 1 g. of unbleached Kraft fibers and 1 g. of polyethylene fibers (containing 10 weight % calcium carbonate as a filler), which mixture was employed on the Noble and Wood sheet-forming machine as set forth in Example 1 to form a heat-sealable paper sheet containing 50 % by weight of the filled polyethylene fibers. Heat-seals were made between two pieces of this sheet on the Robot heat-sealer as explained in Example 96 for a time period of 2 seconds. The resultant bond between the two pieces was of high strength, as it was observed that the fibers of the sheets tore in the vicinity of the heat-seal when the sheets were separated from each other.

EXAMPLE 103

The heat-sealable paper sheet formed in this example is similar to the sheet formed in Example 102, with the exception that the resultant sheet contained 12.5 weight % of the filled polyethylene fibers. To produce the paper sheet of this example, a starting blend or mixture of fibers containing 1.75 g. of unbleached Kraft pulp and 0.25 g. of polyethylene fibers similar to those used in Example 102 (obtained from the high molecular weight linear polyethylene resin used in Example 100 and containing 10 weight % calcium carbonate as a filler) was employed. The dried sheet is produced on the Noble and Wood sheet-forming machine was heat-sealed as in Example 96 on the Robot heat-sealer employing a temperature of 350° F. and a pressure of 38 psi for a time period of 2 seconds. The resultant bond or heat-seal was of high strength as the fibers of the sheet tore when the two pieces thereof which had been heat-sealed were separated.

EXAMPLE 104

A heat-sealable paper sheet was formed by the method of Example 96 on the Noble and Wood sheet-forming machine which had a Kraft fiber content of approximately 12.5 weight %, the remainder being filled polyethylene fibers. The starting mixture of fibers consisted of 0.25 g. of unbleached Kraft pulp and 1.75 g. of polyethylene fibers as used in Example 102 and prepared from the ethylene polymer used in Example 100, but containing 10 weight % calcium carbonate as a filler. The paper sheet so produced was heat-sealed on the Robot heat-sealer by the procedure of Example 96 at a temperature of 300° F. and a paressure of 38 psi for a time period of 2 seconds. The heat-seals thus formed were of a high bond strength which as indicated by observing fiber tear adjacent the heat-seal when two pieces of the sheet were separated from each other after having been heat-sealed.

EXAMPLE 105

A heat-sealable paper sheet was formed in this example similar to the sheet formed in Example 102, with the exceptions that the resultant sheet contained 40.0 weight % of filled polyethylene fibers, and the filler employed was a kaolin clay in the amount of 20 weight %. To produce the paper sheet of this example, a starting blend of fibers containing 1.20 g. of unbleached Kraft pulp and 0.80 g. of polyethylene fibers (obtained from the high molecular weight linear polyethylene resin used in Example 100 and containing 20 weight % kaolin clay as a filler) was employed. A sheet was produced from this blend on the Nobel and Wood sheet-forming machine, dried and heat-sealed as in Example 96 on the Robot heat-sealer employing a temperature of 350° F. and a pressure of 38 psi for a time period of 2 seconds. The resultant bond was of high strength as the fibers of this sheet adjacent the heat-seal tore when the two specimens thereof which had been heat-sealed were separated.

As has been demonstrated in the above Examples 102 and 105, fillers such as calcium carbonate, titanium dioxide, clays such as kaolin clay, silicas and the like may be incorporated in or around the high molecular weight linear polyethylene fibers used in the preparation of the heat-sealable papers of this invention. The use of such filled polyethylene fibers incorporated into the resultant heat-sealable sheets can impact desirous and advantageous properties thereto, such as an improved smoothness, a softer hand, moisture resistance, wet strength and the like. The use of such fillers is optional and if employed they may be used up to a maximum amount of approximately 50 weight % of the polyethylene fibers used in making a heat-sealable paper having the additional desirable properties that these fillers can supply thereto.

We claim:

1. A process for producing a mass of entangled solvent swollen filaments from a high molecular weight polymer consisting essentially of the sequential steps of:

a. dissolving said polymer in a solvent at a temperature above 100° C. to prepare a solution thereof having a viscosity of at least about 50 centipoises;

b. subjecting said heated polymer solution to shearing forces and attenuating said solution into liquid streams to orient the solute polymer molecules in said liquid streams while maintaing said polymer solution at a temperature sufficiently high to maintain substantially all of said polymer in solution;

c. feeding said liquid streams into a cooling zone in which said streams are cooled to a temperature to precipitate substantially all of said solute polymer as solvent swollen polymer filaments; and d. recovering said polymer as a mass of entangled solvent swollen filaments from said solvent;

said polymer being selected from the group consisting of:

1. an olefin polymer having an inherent viscosity of at least 3.5 and selected from the group consisting of:

i. an ethylene homopolymer, ii. a copolymer containng at least 90 weight % of polymerized ethylene and the balance a polymerized olefin hydrocarbon containing at least 4 carbon atoms, iii. a propylene homopolymer, and iv. a copolymer containing at least 50 weight % of polymerized propylene and the balance polymerized ethylene;

2. a mixture of olefin polymers of (1), and 3. a mixture of polymers containing at least 20 weight % of an olefin polymer of (1) and up to 80 weight % of a diluent polymer that is soluble at 100° C. in the solvent employed in step (a).

2. The process of claim 1 in which the olefin polymer employed in the process is an ethylene polymer containing, on a weight basis, at least 90% of polymerized ethylene with any monomer copolymerized therewith being a C-4 or higher olefin hydrocarbon.

3. The process of claim 1 in which the olefin polymer employed therein is a propylene polymer containing, on a weight basis, at least 50% of polymerized propylene and any monomer copolymerized therewith being ethylene.

4. The process of claim 1 in which the olefin polymer employed in the process constitutes the sole polymer employed in the process.

5. The process of claim 4 in which the ethylene polymer employed in the process constitutes the sole polymer employed in the process.

6. The process of claim 5 in which the propylene polymer employed in the process constitutes the sole polymer employed in the process.

7. The process of claim 1 in which the polymer employed in the process consists of a polymer mixture containing, on a weight basis, (a) at least 20% of an ethylene polymer containing, on a weight basis, at least 90% of polymerized ethylene with any monomer copolymerized therewith being a C-4 or higher olefin hydrocarbon, and (b) the balance a copolymer of ethylene with an alkyl ester of acrylic or methacrylic acid.

8. The process of claim 1 in which the polymer employed in the process consists of a polymer mixture containing, on a weight basis, (a) at least 20% of an olefin polymer having an inherent viscosity of at least 3.5, and (b) the balance a copolymer of ethylene with vinyl acetate; said olefin polymer being selected from the group consisting of (1) an ethylene polymer containing, on a weight basis, at least 90% of polymerized ethylene with any monomer copolymerized therewith being a C-4 or higher olefin hydrocarbon; (2) a propylene polymer containing, on a weight basis, at least 50% of polymerized propylene and any monomer copolymerized therewith being ethylene; and (3) mixtures of (1) and (2).

9. The process of claim 1 in which the polymer employed in the process consists of a polymer mixture containing, on a weight basis, (a) at least 20% of an olefin polymer having an inherent viscosity of at least 3.5, and (b) the balance a copolymer of maleic anhydride with either styrene or a mono-1-olefin containing 6 to 18 carbon atoms; said olefin polymer being selected from the group consisting of (1) an ethylene polymer containing, on a weight basis, at least 90% of polymerized ethylene with any monomer copolymerized therewith being a C-4 or higher olefin hydrocarbon; (2) a propylene polymer containing, on a weight basis, at least 50% of polymerized propylene and any monomer copolymerized therewith being ethylene; and (3) mixtures of (1) and (2).

10. The process of claim 1 in which the polymer employed in the process consists of a polymer mixture containing, on a weight basis, (a) at least 20% of an olefin polymer having an inherent viscosity of at least 3.5, and (b) the balance an alkylated N-vinyl-2-pyrrolidone/α-olefin copolymer containing, (c) polymerized monomer units conforming to the formula:

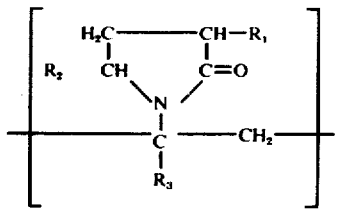

(A)

wherein $R_1$, $R_2$ and $R_3$ are independently hydrogen or an alkyl group containing 2 to about 180 carbon atoms, and (d) polymerized monomer units of the formula:

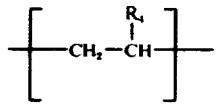

(B)

wherein $R_4$ is hydrogen or an alkyl group containing 1 to about 180 carbon atoms, said unit (A) constituting from about 90 to about 99 mol % of the total of said units (A) plus (B); said olefin polymer being selected from the group consisting of (1) an ethylene polymer containing, on a weight basis, at least 90% of polymerized ethylene with any monomer copolymerized therewith being a C-4 or higher olefin hydrocarbon; (2) a propylene polymer containing, on a weight basis, at least 50% of polymerized propylene and any monomer copolymerized therewith being ethylene; and (3) mixtures of (1) and (2).

11. A process for producing a mass of entangled solvent swollen filaments from a high molecular weight polymer consisting essentially of the sequential steps of:

a. dissolving said polymer in a solvent at a temperature above 100° C. to prepare a solution thereof having a viscosity of at least about 50 centipoises;

b. feeding said heated polymer solution to the inlet of a centrifugal spinning apparatus including therein:

i. a housing, ii. a stationary disc-shaped plate attached to said housing, iii. a rotatable disc-shaped plate within said housing positioned closely adjacent to and parallel to but spaced from said stationary plate, iv. an inlet in the stationary disc-shaped plate adapted to feed liquid onto the rotatable disc-shaped plate, v. a plurality of flails pivotally attached to the circumference of said rotatable plate, vi. means for rotating said rotatable disc-shaped plate, and vii. an outlet in said housing;

c. rotating said rotatable disc-shaped plate at a speed such that said flails are extended so as to define an annulus about the circumference of said rotating plate and said rotating plate has a tangential velocity of at least 100 cm/sec at the position where said polymer solution contacts said rotating disc-shaped plate so that said polymer solution is subjected to shearing forces, attenuated into liquid streams, and said liquid streams are fed into the annulus defined by said flails;

d. feeding a coolant liquid into said housing and about said flails so as to contact the liquid polymer streams entering said annulus defined by said flails so as to cool said polymer streams to a temperature to precipitate substantially all said solute polymer as solvent swollen polymer filaments, the weight of said coolant liquid fed to said housing exceeding the weight of the polymer solution fed to the apparatus in step (b); and e. recovering a mass of entangled solvent swollen polymer filaments from said solvent;

said polymer being selected from the group consisting of:

1. an olefin polymer having an inherent viscosity of at least 3.5 and selected from the group consisting of:
   i. an ethylene homopolymer,
   ii. a copolymer containing at least 90 weight % of polymerized ethylene and the balance a polymerized olefin hydrocarbon containing at least 4 carbon atoms,
   iii. a propylene homopolymer, and
   iv. a copolymer containing at least 50 weight % of polymerized propylene and the balance polymerized ethylene,
2. a mixture of olefin polymers of (1), and
3. a mixture of polymers containing at least 20 weight % of an olefin polymer of (1) and up to 80 weight % of a diluent polymer that is soluble at 100° C. in the solvent employed in step (a).

12. A process for producing a mass of entangled solvent swollen filaments from a high molecular weight polymer consisting essentially of the sequential steps of:

a. dissolving said polymer in a solvent at a temperature above 100° C. to prepare a solution thereof having a viscosity of at least about 50 centipoises;

b. feeding the heated polymer solution to the inlet of a rotatable centrifugal spinning device including therein;
   i. a housing,
   ii. an outer basket mounted within said housing,
   iii. means for cooling said outer basket,
   iv. a perforated inner drum mounted for rotation within said outer basket and spaced therefrom,
   v. an inlet in the housing communicating with the inner drum, and
   vi. an outlet in the housing;

c. rotating said inner drum at a speed to centrifugally throw said polymer solution outwardly therefrom with a centrifugal acceleration of at least 25 times that of gravity so that said polymer solution is subjected to shearing forces and attenuated into liquid streams which impinge upon said outer basket;

d. cooling the outer basket so that said polymer solution impinging thereon is cooled to a temperature to precipitate substantially all of said solute polymer as solvent swollen polymer filaments; and e. recovering said polymer as a mass of entangled solvent swollen filaments from said solvent; said polymer being selected from the group consisting of:

1. an olefin polymer having an inherent viscosity of at least 3.5 and selected from the group consisting of:
   i. an ethylene homopolymer,
   ii. a copolymer containing at least 90 weight % of polymerized ethylene and the balance a polymerized olefin hydrocarbon containing at least 4 carbon atoms,
   iii. a propylene homopolymer, and
   iv. a copolymer containing at least 50 weight % of polymerized propylene and the balance polymerized ethylene,
2. a mixture of olefin polymers of (1), and
3. a mixture of polymers containing at least 20 weight % of an olefin polymer of (1) and up to 80 weight % of a diluent polymer that is soluble at 100° C. in the solvent employed in step (a).

13. A process for producing a mass of entangled solvent swollen filaments from a high molecular weight polymer consisting essentially of the sequential steps of:

a. dissolving said polymer in a solvent at a temperature above 100° C. to prepare a solution thereof having a viscosity of at least about 50 centipoises;

b. forcing said heated polymer solution through an elongated die to shear said solution and thereby orient the polymer molecules therein;

c. feeding the stream of polymer solution from said die into a cooling zone in which the stream of polymer solution is cooled to a temperature to precipitate substantially all of said solute polymer as solvent swollen polymer filaments; and d. recovering said polymer as a mass of entangled solvent swollen fine filaments from said solvent;

said polymer being selected from the group consisting of:

1. an olefin polymer having an inherent viscosity of at least 3.5 and selected from the group consisting of:
   i. an ethylene homopolymer,
   ii. a copolymer containing at least 90 weight % of polymerized ethylene and the balance a polymerized olefin hydrocarbon containing at least 4 carbon atoms.
   iii. a propylene homopolymer, and
   iv. a copolymer containing at least 50 weight % of polymerized propylene and the balance polymerized ethylene,
2. a mixture of olefin polymers of (1), and
3. a mixture of polymers containing at least 20 weight % of an olefin polymer of (1) and up to 80 weight % of a diluent polymer that is soluble at 100° C. in the solvent employed in step (a).

14. A process for producing fibrils suitable for the manufacture of water leaves from a high molecular weight polymer consisting essentially of the sequential steps of:

a. dissolving said polymer in a solvent at a temperature above 100° C. to prepare a solution thereof having a viscosity of at least about 50 centipoises;

b. subjecting said heated polymer solution to shearing forces and attenuating said solution into liquid streams to orient the solute polymer molecules in said liquid streams while maintaining said polymer solution at a temperature sufficiently high to maintain substantially all of said polymer in solution;

c. feeding said liquid streams into a cooling zone in which said streams are cooled to a temperature to precipitate substantially all said solute polymer as solvent swollen polymer filaments;

d. recovering said polymer as a mass of entangled solvent swollen filaments from said solvent;

e. beating said filaments in a liquid which is a non-solvent for the polymer for a time sufficient to break down said filaments into a plurality of individual fibrils; and f. separating said fibrils from said non-solvent liquid; said polymer being selected from the group consisting of:

1. an olefin polymer having an inherent viscosity of at least 3.5 and selected from the group consisting of:
   i. an ethylene homopolymer,
   ii. a copolymer containing at least 90 weight % of polymerized ethylene and the balance a polymerized olefin hydrocarbon containing at least 4 carbon atoms.
   iii. a propylene homopolymer, and
   iv. a copolymer containing at least 50 weight % of polymerized propylene and the balance polymerized ethylene,
2. a mixture of olefin polymers of (1), and
3. a mixture of polymers containing at least 20 weight % of an olefin polymer of (1) and up to 80 weight % of a diluent polymer that is soluble at 100° C. in the solvent employed in step (a).

15. A process for producing fibrils suitable for the manufacture of water leaves from a high molecular weight polymer consisting essentially of the sequential steps of:

a. dissolving said polymer in a solvent at a temperature above 100° C. to prepare a solution thereof having a viscosity of at least about 50 centipoises;

b. feeding said heated polymer solution to the inlet of a centrifugal spinning apparatus including therein:
   i. a housing,
   ii. a stationary disc-shaped plate attached to said housing,
   iii. a rotatable disc-shaped plate within said housing positioned closely adjacent to and parallel to but spaced from said stationary plate,
   iv. an inlet in the stationary disc-shaped plate adapted to feed liquid onto the rotatable disc-shaped plate,
   v. a plurality of flails pivotally attached to the circumference of said rotatable plate,
   vi. means for rotating said rotatable disc-shaped plate, and
   vii. an outlet in said housing;

c. rotating said rotatable disc-shaped plate at a speed such that said flails are extended so as to define an annulus about the circumference of said rotating plate and said rotating plate has a tangential velocity of at least 100 cm/sec at the position where said polymer solution contacts said rotating disc-shaped plate so that said polymer solution is subjected to shearing forces, attenuated into liquid streams, and said liquid streams are fed into the annulus defined by said flails;

d. feeding a coolant liquid into said housing and about said flails so as to contact the liquid polymer streams entering said annulus defined by said flails so as to cool said polymer streams to a temperature to precipitate substantially all said solute polymer as solvent swollen polymer filaments, the weight of said coolant liquid fed to said housing exceeding the weight of the polymer solution fed to the apparatus in step (b);

e. recovering a mass of entangled solvent swollen polymer filaments from said solvent;

f. beating said filaments in a liquid which is a nonsolvent for the polymer for a time sufficient to break down said filaments into a plurality of individual fibrils; and g. separating said fibrils from said nonsolvent liquid; said polymer being selected from the group consisting of:

1. an olefin polymer having an inherent viscosity of at least 3.5 and selected from the group consisting of:
   i. an ethylene homopolymer,
   ii. a copolymer containing at least 90 weight % of polymerized ethylene and the balance a polymerized olefin hydrocarbon containing at least 4 carbon atoms,
   iii. a propylene homopolymer, and
   iv. a copolymer containing at least 50 weight % of polymerized propylene and the balance polymerized ethylene,
2. a mixture of olefin polymers of (1), and
3. a mixture of polymers containing at least 20 weight % of an olefin polymer of (1) and up to 80 weight % of a diluent polymer that is soluble at 100° C. in the solvent employed in step (a).

16. A process for producing fibrils suitable for the manufacture of water leaves from a high molecular weight polymer consisting essentially of the sequential steps of:

a. dissolving said polymer in a solvent at a temperature above 100° C. to prepare a solution thereof having a viscosity of at least about 50 centipoises;

b. feeding the heated polymer solution to the inlet of a rotatable centrifugal spinning device including therein;
   i. a housing,
   ii. an outer basket mounted within said housing,
   iii. means for cooling said outer basket,
   iv. a perforated inner drum mounted for rotation within said outer basket and spaced therefrom,
   v. an inlet in the housing communicating with the inner drum, and
   vi. an outlet in the housing;

c. rotating said inner drum at a speed to centrifugally throw said polymer solution outwardly therefrom with a centrifugal acceleration of at least 25 times that of gravity so that said polymer solution is subjected to shearing forces and attenuated into liquid streams which impinge upon said outer basket;

d. cooling the outer basket so that said polymer solution impinging thereon is cooled to a temperature to precipitate substantially all of said solute polymer as solvent swollen polymer filaments;

e. recovering said polymer as a mass of entangled solvent swollen filaments from said solvent;

f. beating said filaments in a liquid which is a non-solvent for the polymer for a time sufficient to break down said filaments into a plurality of individual fibrils; and g. separating said fibrils from said non-solvent liquid; said polymer being selected from the group consisting of:

1. an olefin polymer having an inherent viscosity of at least 3.5 and selected from the group consisting of:
   i. an ethylene homopolymer, ii. a copolymer containing at least 90 weight % of polymerized ethylene and the balance a polymerized olefin hydrocarbon containing at least 4 carbon atoms, iii. a propylene homopolymer, and iv. a copolymer containing at least 50 weight % of polymerized propylene and the balance polymerized ethylene, 2. a mixture of olefin polymers of (1), and 3. a mixture of polymers containing at least 20 weight percent of an olefin polymer of (1) and up to 80 weight % of a diluent polymer that is soluble at 100° C. in the solvent employed in step (a).

17. A process for producing fibrils suitable for the manufacture of water leaves from a high molecular weight polymer consisting essentially of the sequential steps of:

a. dissolving a polymer in a solvent at a temperature above 100° C. to prepare a solution thereof having a viscosity of at least about 50 centipoises;

b. forcing said heated polymer solution through an elongated die to shear said solution and thereby orient the polymer molecules therein;

c. feeding the stream of polymer solution from said die into a cooling zone in which the stream of polymer solution is cooled to a temperature to precipitate substantially all of said solute polymer as solvent swollen polymer filaments;

d. recovering said polymer as a mass of entangled solvent swollen fine filaments from said solvent;

e. chopping said solvent swollen filaments into discrete lengths;

f. beating said chopped filaments in a liquid which is a nonsolvent for the polymer for a time sufficient to break down said filaments into a plurality of individual fibrils; and g. separating said fibrils from said nonsolvent liquid;

said polymer being selected from the group consisting of:

1. an olefin polymer having an inherent viscosity of at least 3.5 and selected from the group consisting of:

i. an ethylene homopolymer, ii. a copolymer containing at least 90 weight % of polymerized ethylene and the balance a polymerized olefin hydrocarbon containing at least 4 carbon atoms, iii. a propylene homopolymer, and iv. a copolymer containing at least 50 weight % of polymerized propylene and the balance polymerized ethylene, 2. a mixture of olefin polymers of (1), and 3. a mixture of polymers containing at least 20 weight % of an olefin polymer of (1) and up to 80 weight % of a diluent polymer that is soluble at 100° C. in the solvent employed in step (a).

* * * * *